US009892695B2

(12) United States Patent
Nishiike et al.

(10) Patent No.: US 9,892,695 B2
(45) Date of Patent: Feb. 13, 2018

(54) DISPLAY UNIT, ELECTRONIC APPARATUS, AND METHOD OF DRIVING DISPLAY UNIT

(71) Applicant: Sony Corporation, Tokyo (JP)

(72) Inventors: Akihito Nishiike, Kanagawa (JP); Keiichi Akamatsu, Kanagawa (JP); Kitsuko Hatakeyama, Kanagawa (JP); Ryo Kasegawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 438 days.

(21) Appl. No.: 14/078,567

(22) Filed: Nov. 13, 2013

(65) Prior Publication Data

US 2014/0146099 A1 May 29, 2014

(30) Foreign Application Priority Data

Nov. 26, 2012 (JP) ..... 2012-257580

(51) Int. Cl.

*G09G 5/02* (2006.01)
*G09G 3/34* (2006.01)
*G09G 3/20* (2006.01)

(52) U.S. Cl.

CPC ..... *G09G 3/344* (2013.01); *G09G 3/2074* (2013.01); *G09G 2300/0452* (2013.01); *G09G 2320/0613* (2013.01); *G09G 2340/0407* (2013.01)

(58) Field of Classification Search

None

See application file for complete search history.

(56) References Cited

U.S. PATENT DOCUMENTS 5,852,470 A * 12/1998 Kondo ..... H04N 7/0125 348/448
7,898,623 B2 * 3/2011 Kimura ..... G09G 3/3241 349/108
8,545,035 B1 * 10/2013 Beguin ..... G09G 3/3413 345/102
2006/0197738 A1 * 9/2006 Kawai ..... G09G 3/344 345/107
2008/0174851 A1 * 7/2008 Kawai ..... G02F 1/13624 359/296
2011/0234582 A1 * 9/2011 Daiku ..... G02B 27/2214 345/419
2011/0285746 A1 * 11/2011 Swic ..... G09G 5/02 345/597

(Continued)

FOREIGN PATENT DOCUMENTS

JP 2006-243478 A 9/2006

*Primary Examiner* — Jennifer Mehmood
*Assistant Examiner* — Stephen T Reed
(74) *Attorney, Agent, or Firm* — Chip Law Group

(57) ABSTRACT

A display unit includes a plurality of pixels arranged in a two-dimensional matrix. An image is displayed in a first display mode and a second display mode. In the first display mode, one pixel is configured of a set including J (where J is an integer of 2 or more) first unit pixels emitting a first color, J second unit pixels emitting a second color, and J third unit pixels emitting a third color, and image display is performed through control of operation of each of the unit pixels. In the second display mode, one pixel is configured of a set including j (where j is an integer of 1 or more and less than J) first unit pixels, j second unit pixels, and j third unit pixels, and image display is performed through control of operation of each of the unit pixels.

17 Claims, 16 Drawing Sheets

(56) References Cited

U.S. PATENT DOCUMENTS

| | | | | |
|---|---|---|---|---|
| 2012/0032947 | A1* | 2/2012 | Phan | G09G 3/003 345/419 |
| 2012/0242715 | A1* | 9/2012 | Muto | G09B 5/062 345/690 |

* cited by examiner

| | | | | | | | | | | | |
|---|---|---|---|---|---|---|---|---|---|---|---|
| R | R | G | G | R | R | G | G | R | R | G | G |
| R | R | G | G | R | R | G | G | R | R | G | G |
| W | W | B | B | W | W | B | B | W | W | B | B |
| W | W | B | B | W | W | B | B | W | W | B | B |
| R | R | G | G | R | R | G | G | R | R | G | G |
| R | R | G | G | R | R | G | G | R | R | G | G |
| W | W | B | B | W | W | B | B | W | W | B | B |
| W | W | B | B | W | W | B | B | W | W | B | B |

FIG. 1A

| | | | | | | | | | | | |
|---|---|---|---|---|---|---|---|---|---|---|---|
| R | R | G | G | R | R | G | G | R | R | G | G |
| R | R | G | G | R | R | G | G | R | R | G | G |
| W | W | B | B | W | W | B | B | W | W | B | B |
| W | W | B | B | W | W | B | B | W | W | B | B |
| R | R | G | G | R | R | G | G | R | R | G | G |
| R | R | G | G | R | R | G | G | R | R | G | G |
| W | W | B | B | W | W | B | B | W | W | B | B |
| W | W | B | B | W | W | B | B | W | W | B | B |

FIG. 1B

| | | | | | | | | | | | |
|---|---|---|---|---|---|---|---|---|---|---|---|
| R | G | R | G | R | G | R | G | R | G | R | G |
| W | B | W | B | W | B | W | B | W | B | W | B |
| R | G | R | G | R | G | R | G | R | G | R | G |
| W | B | W | B | W | B | W | B | W | B | W | B |
| R | G | R | G | R | G | R | G | R | G | R | G |
| W | B | W | B | W | B | W | B | W | B | W | B |
| R | G | R | G | R | G | R | G | R | G | R | G |
| W | B | W | B | W | B | W | B | W | B | W | B |

FIG. 2A

| | | | | | | | | | | | |
|---|---|---|---|---|---|---|---|---|---|---|---|
| R | G | R | G | R | G | R | G | R | G | R | G |
| W | B | W | B | W | B | W | B | W | B | W | B |
| R | G | R | G | R | G | R | G | R | G | R | G |
| W | B | W | B | W | B | W | B | W | B | W | B |
| R | G | R | G | R | G | R | G | R | G | R | G |
| W | B | W | B | W | B | W | B | W | B | W | B |
| R | G | R | G | R | G | R | G | R | G | R | G |
| W | B | W | B | W | B | W | B | W | B | W | B |

FIG. 2B

| | | | | | | | | | | | | | | | |
|---|---|---|---|---|---|---|---|---|---|---|---|---|---|---|---|
| R | R | R | R | G | G | G | G | R | R | R | R | G | G | G | G |
| R | R | R | R | G | G | G | G | R | R | R | R | G | G | G | G |
| R | R | R | R | G | G | G | G | R | R | R | R | G | G | G | G |
| R | R | R | R | G | G | G | G | R | R | R | R | G | G | G | G |
| W | W | W | W | B | B | B | B | W | W | W | W | B | B | B | B |
| W | W | W | W | B | B | B | B | W | W | W | W | B | B | B | B |
| W | W | W | W | B | B | B | B | W | W | W | W | B | B | B | B |
| W | W | W | W | B | B | B | B | W | W | W | W | B | B | B | B |
| R | R | R | R | G | G | G | G | R | R | R | R | G | G | G | G |
| R | R | R | R | G | G | G | G | R | R | R | R | G | G | G | G |
| R | R | R | R | G | G | G | G | R | R | R | R | G | G | G | G |
| R | R | R | R | G | G | G | G | R | R | R | R | G | G | G | G |
| W | W | W | W | B | B | B | B | W | W | W | W | B | B | B | B |
| W | W | W | W | B | B | B | B | W | W | W | W | B | B | B | B |
| W | W | W | W | B | B | B | B | W | W | W | W | B | B | B | B |
| W | W | W | W | B | B | B | B | W | W | W | W | B | B | B | B |

FIG. 3A

| | | | | | | | | | | | | | | | |
|---|---|---|---|---|---|---|---|---|---|---|---|---|---|---|---|
| R | R | R | R | G | G | G | G | R | R | R | R | G | G | G | G |
| R | R | R | R | G | G | G | G | R | R | R | R | G | G | G | G |
| R | R | R | R | G | G | G | G | R | R | R | R | G | G | G | G |
| R | R | R | R | G | G | G | G | R | R | R | R | G | G | G | G |
| W | W | W | W | B | B | B | B | W | W | W | W | B | B | B | B |
| W | W | W | W | B | B | B | B | W | W | W | W | B | B | B | B |
| W | W | W | W | B | B | B | B | W | W | W | W | B | B | B | B |
| W | W | W | W | B | B | B | B | W | W | W | W | B | B | B | B |
| R | R | R | R | G | G | G | G | R | R | R | R | G | G | G | G |
| R | R | R | R | G | G | G | G | R | R | R | R | G | G | G | G |
| R | R | R | R | G | G | G | G | R | R | R | R | G | G | G | G |
| R | R | R | R | G | G | G | G | R | R | R | R | G | G | G | G |
| W | W | W | W | B | B | B | B | W | W | W | W | B | B | B | B |
| W | W | W | W | B | B | B | B | W | W | W | W | B | B | B | B |
| W | W | W | W | B | B | B | B | W | W | W | W | B | B | B | B |
| W | W | W | W | B | B | B | B | W | W | W | W | B | B | B | B |

FIG. 3B

| | | | | | | | | | | | | | | | |
|---|---|---|---|---|---|---|---|---|---|---|---|---|---|---|---|
| R | R | G | G | R | R | G | G | R | R | G | G | R | R | G | G |
| R | R | G | G | R | R | G | G | R | R | G | G | R | R | G | G |
| W | W | B | B | W | W | B | B | W | W | B | B | W | W | B | B |
| W | W | B | B | W | W | B | B | W | W | B | B | W | W | B | B |
| R | R | G | G | R | R | G | G | R | R | G | G | R | R | G | G |
| R | R | G | G | R | R | G | G | R | R | G | G | R | R | G | G |
| W | W | B | B | W | W | B | B | W | W | B | B | W | W | B | B |
| W | W | B | B | W | W | B | B | W | W | B | B | W | W | B | B |
| R | R | G | G | R | R | G | G | R | R | G | G | R | R | G | G |
| R | R | G | G | R | R | G | G | R | R | G | G | R | R | G | G |
| W | W | B | B | W | W | B | B | W | W | B | B | W | W | B | B |
| W | W | B | B | W | W | B | B | W | W | B | B | W | W | B | B |
| R | R | G | G | R | R | G | G | R | R | G | G | R | R | G | G |
| R | R | G | G | R | R | G | G | R | R | G | G | R | R | G | G |
| W | W | B | B | W | W | B | B | W | W | B | B | W | W | B | B |
| W | W | B | B | W | W | B | B | W | W | B | B | W | W | B | B |

FIG. 4A

| | | | | | | | | | | | | | | | |
|---|---|---|---|---|---|---|---|---|---|---|---|---|---|---|---|
| R | R | G | G | R | R | G | G | R | R | G | G | R | R | G | G |
| R | R | G | G | R | R | G | G | R | R | G | G | R | R | G | G |
| W | W | B | B | W | W | B | B | W | W | B | B | W | W | B | B |
| W | W | B | B | W | W | B | B | W | W | B | B | W | W | B | B |
| R | R | G | G | R | R | G | G | R | R | G | G | R | R | G | G |
| R | R | G | G | R | R | G | G | R | R | G | G | R | R | G | G |
| W | W | B | B | W | W | B | B | W | W | B | B | W | W | B | B |
| W | W | B | B | W | W | B | B | W | W | B | B | W | W | B | B |
| R | R | G | G | R | R | G | G | R | R | G | G | R | R | G | G |
| R | R | G | G | R | R | G | G | R | R | G | G | R | R | G | G |
| W | W | B | B | W | W | B | B | W | W | B | B | W | W | B | B |
| W | W | B | B | W | W | B | B | W | W | B | B | W | W | B | B |
| R | R | G | G | R | R | G | G | R | R | G | G | R | R | G | G |
| R | R | G | G | R | R | G | G | R | R | G | G | R | R | G | G |
| W | W | B | B | W | W | B | B | W | W | B | B | W | W | B | B |
| W | W | B | B | W | W | B | B | W | W | B | B | W | W | B | B |

FIG. 4B

| | | | | | | | | | | | | | | | | | |
|---|---|---|---|---|---|---|---|---|---|---|---|---|---|---|---|---|---|
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |

FIG. 13A

| | | | | | | | | | | | | | | | | | |
|---|---|---|---|---|---|---|---|---|---|---|---|---|---|---|---|---|---|
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |
| R | R | R | G | G | G | B | B | B | R | R | R | G | G | G | B | B | B |

FIG. 13B

| | |
|---|---|
| 0.00 | 0.00 |
| 0.00 | 0.00 |

0.00

| | |
|---|---|
| 0.00 | 0.25 |
| 0.00 | 0.00 |

0.25

| | |
|---|---|
| 0.00 | 0.25 |
| 0.25 | 0.00 |

0.50

| | |
|---|---|
| 0.00 | 0.25 |
| 0.25 | 0.25 |

0.75

| | |
|---|---|
| 0.25 | 0.25 |
| 0.25 | 0.25 |

1.00

| | |
|---|---|
| 0.25 | 0.50 |
| 0.25 | 0.25 |

1.25

| | |
|---|---|
| 0.25 | 0.50 |
| 0.50 | 0.25 |

1.50

| | |
|---|---|
| 0.25 | 0.50 |
| 0.50 | 0.50 |

1.74

| | |
|---|---|
| 0.50 | 0.50 |
| 0.50 | 0.50 |

2.00

| | |
|---|---|
| 0.50 | 0.75 |
| 0.50 | 0.50 |

2.25

| | |
|---|---|
| 0.50 | 0.75 |
| 0.75 | 0.50 |

2.50

| | |
|---|---|
| 0.50 | 0.75 |
| 0.75 | 0.75 |

2.75

| | |
|---|---|
| 0.75 | 0.75 |
| 0.75 | 0.75 |

3.00

FIG. 16

DISPLAY UNIT, ELECTRONIC APPARATUS, AND METHOD OF DRIVING DISPLAY UNIT

CROSS REFERENCE TO RELATED APPLICATIONS

This application claims the benefit of Japanese Priority Patent Application JP 2012-257580 filed Nov. 26, 2012, the entire contents of which are incorporated herein by reference.

BACKGROUND

The present disclosure relates to a display unit, an electronic apparatus, and a method of driving a display unit.

In a display unit having memory performance typified by an electrophoretic display unit, it is difficult to secure a grayscale number of 256, which is the gray scale number of the cathode ray tube etc., or more while the gray scale number is a standard for expression of contrasting density of an image. In most cases, such a display unit expresses only about 16 grayscales. Thus, in such a display unit, the grayscale number is increased in a pseudo manner. A time division method and an area grayscale method are known as typical approaches for such pseudo-increase. In the time division method, a display unit is desired to have a certain level of response speed (display speed), but the display unit does not have sufficiently high response speed. As a result, the time division method is practically not usable. Hence, the area grayscale method as disclosed in, for example, Japanese Unexamined Patent Application Publication No. 2006-243478 is frequently used for the display unit having the memory performance.

SUMMARY

In a display unit for color display, one pixel may be configured of three or four sub-pixels, for example. In the case of displaying an image based on the area grayscale method, one sub-pixel is configured of a plurality of unit pixels. For example, when a basic grayscale number of one unit pixel is N and the number of unit pixels configuring one sub-pixel is n, the pseudo-grayscale number is represented as pseudo-grayscale number=n×(N−1)+1. For example, when N=4 (specifically, normalized luminance values: 0.00, 0.25, 0.50, and 0.75) and n=4 are given, the pseudo-grayscale number is 13 as illustrated in a conceptual diagram of FIG. 16. Image display based on such an area grayscale method, however, causes an increase in number of unit pixels configuring one sub-pixel, which disadvantageously leads to reduction in image resolution of a display unit.

It is therefore desirable to provide a display unit capable of, as desired, performing image display with a large grayscale number and performing high definition image display, an electronic apparatus including such a display unit, and a method of driving a display unit using such a display unit.

According to a first embodiment of the present disclosure, there is provided a display unit, the display unit including a plurality of pixels arranged in a two-dimensional matrix, wherein an image is displayed in a first display mode and a second display mode, in the first display mode, one pixel is configured of a set including J (where J is an integer of 2 or more) first unit pixels emitting a first color, J second unit pixels emitting a second color, and J third unit pixels emitting a third color, and image display is performed through control of operation of each of the unit pixels, and in the second display mode, one pixel is configured of a set including j (where j is an integer of 1 or more and less than J) first unit pixels, j second unit pixels, and j third unit pixels, and image display is performed through control of operation of each of the unit pixels.

According to a second embodiment of the present disclosure, there is provided a display unit, the display unit including a plurality of pixels arranged in a two-dimensional matrix, wherein an image is displayed in a first display mode and a second display mode, in the first display mode, one pixel is configured of a set of $4^p$ (where p is an integer of 1 or more) first unit pixels emitting a first color, $4^p$ second unit pixels emitting a second color, $4^p$ third unit pixels emitting a third color, and $4^p$ fourth unit pixels emitting a fourth color, and image display is performed through control of operation of each of the unit pixels, and in the second display mode, one pixel is configured of a set of $4^{p'}$ (where p' is an integer of (p−1) or less) first unit pixels, $4^{p'}$ second unit pixels, $4^{p'}$ third unit pixels, and $4^{p'}$ fourth unit pixels, and image display is performed through control of operation of each of the unit pixels.

According to a third embodiment of the present disclosure, there is provided a display unit, the display unit including a plurality of pixels arranged in a two-dimensional matrix, wherein an image is displayed in a first display mode and a second display mode, in the first display mode, one pixel is configured of a set of 3×q (where q is 1 or an even number) first unit pixels emitting a first color, 3×q second unit pixels emitting a second color, and 3×q third unit pixels emitting a third color, and image display is performed through control of operation of each of the unit pixels, and in the second display mode, q'=1 is given in the case of q=1, q'=1, 2, or 3 is given in the case of q=2, and q'=(3×q)/2 is given in the case of q being an even number of more than 2, and one pixel is configured of a set of q' first unit pixels, q' second unit pixels, and q' third unit pixels, and image display is performed through control of operation of each of the unit pixels.

According to an embodiment of the present disclosure, there is provided an electronic apparatus provided with a display unit, the display unit including a plurality of pixels arranged in a two-dimensional matrix, wherein an image is displayed in a first display mode and a second display mode, in the first display mode, one pixel is configured of a set including J (where J is an integer of 2 or more) first unit pixels emitting a first color, J second unit pixels emitting a second color, and J third unit pixels emitting a third color, and image display is performed through control of operation of each of the unit pixels, and in the second display mode, one pixel is configured of a set including j (where j is an integer of 1 or more and less than J) first unit pixels, j second unit pixels, and j third unit pixels, and image display is performed through control of operation of each of the unit pixels.

According to an embodiment of the present disclosure, there is provided a method of driving a display unit, the display unit including a plurality of pixels arranged in a two-dimensional matrix, the method including:

allowing the display unit to display an image in a first display mode and a second display mode;

in the first display mode, allowing the display unit to perform image display by configuring one pixel by a set including J (where J is an integer of 2 or more) first unit pixels emitting a first color, J second unit pixels emitting a second color, and J third unit pixels emitting a third color, and controlling operation of each of the unit pixels;

in the second display mode, allowing the display unit to perform image display by configuring one pixel by a set including j (where j is an integer of 1 or more and less than J) first unit pixels, j second unit pixels, and j third unit pixels, and controlling operation of each of the unit pixels; and switching a display mode between the first display mode and the second display mode based on a mode switching signal, the mode switching signal allowing the first display mode and the second display mode to be switched from each other.

In the above-described respective embodiments of the present disclosure, in the first display mode, one pixel is configured of a set of a first number of first unit pixels, second unit pixels, and third unit pixels, and image display is performed through control of operation of each of the unit pixels, while in the second display mode, one pixel is configured of a set of a second number, which is smaller than the first number, of first unit pixels, second unit pixels, and third unit pixels, and image display is performed through control of operation of each of the unit pixels. Hence, it is possible to perform image display with a large grayscale number in the first display mode, and perform high-definition image display in the second display mode. Specifically, it is possible to provide a display unit capable of performing image display with a large grayscale number and/or performing high-definition image display, as desired. Specifically, it is possible to provide a display unit capable of performing two types of display, i.e., display with improved display performance due to an increase in grayscale number based on the area grayscale method and display causing no reduction in image definition, and allowing optimal display for both of an image desired to have a large grayscale number such as a photographic image, and a high-definition image such as a letter image.

It is to be understood that both the foregoing general description and the following detailed description are exemplary, and are intended to provide further explanation of the technology as claimed.

BRIEF DESCRIPTION OF THE DRAWINGS

FIGS. 1A and 1B are schematic diagrams of an arrangement state of unit pixels showing one pixel in a first display mode and an arrangement state of unit pixels showing one pixel in a second display mode, respectively, in a display unit of Example 1.

FIGS. 2A and 2B are schematic diagrams of an arrangement state of unit pixels showing one pixel in the first display mode and an arrangement state of unit pixels showing one pixel in the second display mode, respectively, in a Modification of the display unit of the Example 1.

FIGS. 3A and 3B are schematic diagrams of an arrangement state of unit pixels showing one pixel in the first display mode and an arrangement state of unit pixels showing one pixel in the second display mode, respectively, in another Modification of the display unit of the Example 1.

FIGS. 4A and 4B are schematic diagrams of an arrangement state of unit pixels showing one pixel in the first display mode and an arrangement state of unit pixels showing one pixel in the second display mode, respectively, in still another Modification of the display unit of the Example 1.

FIGS. 13A and 13B are schematic diagrams of an arrangement state of unit pixels showing one pixel in the first display mode and an arrangement state of unit pixels showing one pixel in the second display mode, respectively, in still another Modification of the display unit of the Example 2.

FIG. 16 is a conceptual diagram of unit pixels for explaining a pseudo-grayscale number when a basic grayscale number of one unit pixel is 4, and when the number of unit pixels configuring one sub-pixel is 4.

DETAILED DESCRIPTION

Figure 5A:
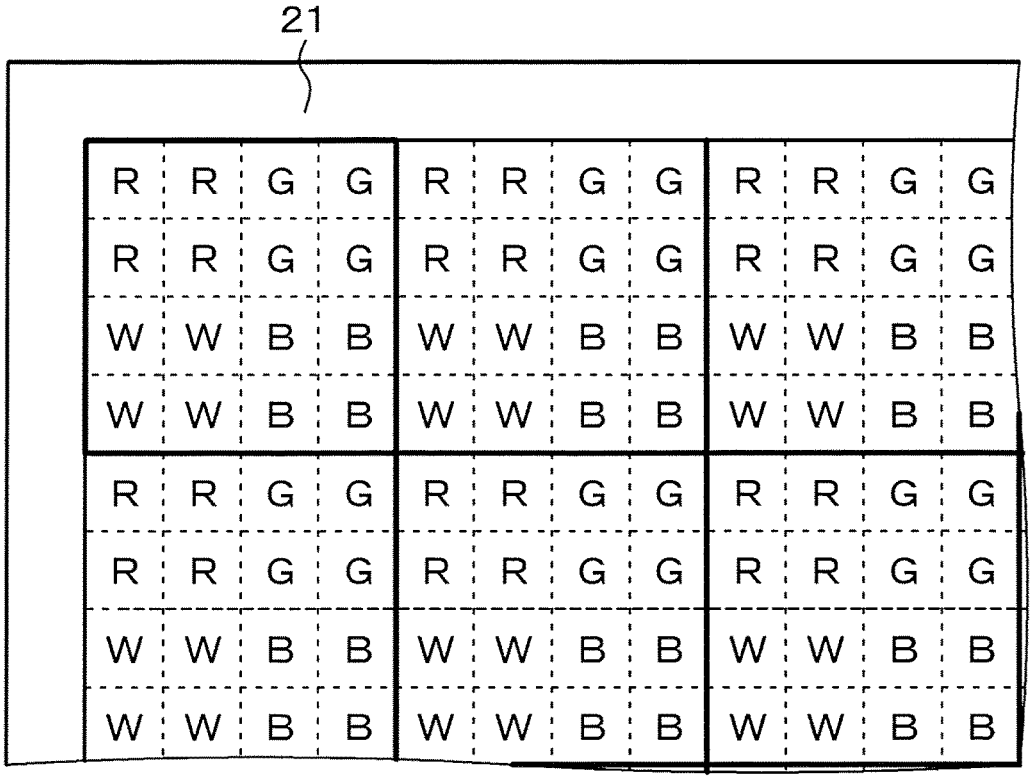
FIGS. 5A and 5B are diagrams each explaining display processing of an image at an edge portion of an image display region of the display unit.

Although the present disclosure will now be described based on Examples with reference to the accompanying drawings, the disclosure is not limited thereto, and various numerical values and materials in the Examples are merely shown as examples. It is to be noted that description is made in the following order.

1. Display Units According to First to Third Embodiments of the Disclosure, Electronic Apparatus of the Disclosure, Method of Driving the Display Unit of the Disclosure, and General Description.

2. Example 1 (display units according to the first and second embodiments of the disclosure, an electronic apparatus of the disclosure, and a method of driving a display unit of the disclosure).

3. Example 2 (display units according to the first and third embodiments of the disclosure, an electronic apparatus of the disclosure, and a method of driving a display unit of the disclosure), and others.

[Display Units According to First to Third Embodiments of the Disclosure, Electronic Apparatus of the Disclosure, Method of Driving the Display Unit of the Disclosure, and General Description]

A display unit according to a first embodiment of the disclosure, a display unit according to the first embodiment of the disclosure in an electronic apparatus of the disclosure, or a display unit according to the first embodiment of the disclosure in a method of driving the display unit of the disclosure (hereinafter, such display units are generally referred to as "display units according to the first embodiment of the disclosure") is allowed to be into a form where in a first display mode, one pixel is configured of a set of J first unit pixels, J second unit pixels, J third unit pixels, and J fourth unit pixels emitting a fourth color, and image display is performed through control of operation of each of the unit pixels, and in a second display mode, one pixel is configured of a set of j first unit pixels, j second unit pixels, j third unit pixels, and j fourth unit pixels, and image display is performed through control of operation of each of the unit pixels. In such a form, a combination (J, j) may include (4, 1), (16, 1), and (16, 4).

Alternatively, the display units according to the first embodiment of the disclosure are each allowed to be into a form where in the first display mode, one pixel is configured of a set of J first unit pixels, J second unit pixels, and J third unit pixels, and image display is performed through control of operation of each of the unit pixels, and in the second display mode, one pixel is configured of a set of j first unit pixels, j second unit pixels, and j third unit pixels, and image display is performed through control of operation of each of the unit pixels. In such a form, a combination (J, j) may include (3, 1), (6, 1), (6, 2) and (6, 3).

The display units according to the first embodiment of the disclosure including the above-described various preferable forms are each allowed to be into a form where grayscale control is performed through control of operation of each of the unit pixels in the first display mode. Furthermore, the display units according to the first embodiment of the disclosure including the above-described various preferable forms are each allowed to be into a form where image display with a higher image resolution than that in the first display mode is performed in the second display mode.

A display unit according to a second embodiment of the disclosure, or a display unit according to the second embodiment of the disclosure in the electronic apparatus of the disclosure (hereinafter, such display units are generally referred to as "display units according to the second embodiment of the disclosure") is allowed to be into a form where grayscale control is performed through control of operation of each of the unit pixels in the first display mode. The display unit according to the second embodiment of the disclosure including such a form is allowed to be into a form where image display with an image resolution $4^{p-p'}$ times as high as that in the first display mode is performed in the second display mode. Furthermore, the display units according to the second embodiment of the disclosure including such preferable forms are each allowed to be into a form where $4^p$ first unit pixels in the first display mode occupy a first quadrant of one pixel in the first display mode while being arranged in $2^p \times 2^p$, $4^p$ second unit pixels in the first display mode occupy a second quadrant of one pixel in the first display mode while being arranged in $2^p \times 2^p$, $4^p$ third unit pixels in the first display mode occupy a third quadrant of one pixel in the first display mode while being arranged in $2^p \times 2^p$, $4^p$ fourth unit pixels in the first display mode occupy a fourth quadrant of one pixel in the first display mode while being arranged in $2^p \times 2^p$, and $p'=(p-1)$ is satisfied.

A display unit according to a third embodiment of the disclosure, or a display unit according to the third embodiment of the disclosure in the electronic apparatus of the disclosure (hereinafter, such display units are generally referred to as "display units according to the third embodiment of the disclosure") is allowed to be into a form where grayscale control is performed through control of operation of each of the unit pixels in the first display mode. The display units according to the third embodiment of the disclosure including such a form are each allowed to be into a form where image display with a higher image resolution than that in the first display mode is performed in the second display mode.

The display units according to the first embodiment of the disclosure, the display units according to the second embodiment of the disclosure, and the display units according to the third embodiment of the disclosure, which include the various preferable forms as described above, are each allowed to be into a configuration where an image is relatively reduced in the first display mode while being relatively expanded in the second display mode. Specifically, image resolution is relatively decreased in the first display mode while being relatively increased in the second display mode. Processing of relative image reduction and processing of relative image expansion may be performed according to any of known techniques.

Furthermore, the display units according to the first embodiment of the disclosure, the display units according to the second embodiment of the disclosure, and the display units according to the third embodiment of the disclosure, which include the various preferable forms and configurations as described above, are each allowed to be into a configuration having a mode switcher configured to switch a mode between the first display mode and the second display mode, or allowed to be into a configuration where the first display mode and the second display mode are switched from each other based on an external mode switching signal that allows the first display mode and the second display mode to be switched from each other. Alternatively, whether image display is to be performed in the first display mode or in the second display mode may be determined based on an image to be displayed.

Furthermore, the display units according to the first embodiment of the disclosure, the display units according to the second embodiment of the disclosure, and the display units according to the third embodiment of the disclosure, which include the various preferable forms and configurations as described above, may each include an electrophoretic display unit as the display unit. However, the display units are not limited thereto, and may include any of display units that display images based on the area grayscale method, for example, a liquid crystal display unit, an organic electroluminescent display unit, and an inorganic electroluminescent display unit. Any format or type of image display may be used for the electrophoretic display unit.

In the display units according to the first embodiment of the disclosure, the display units according to the second embodiment of the disclosure, and the display units according to the third embodiment of the disclosure (hereinafter, these may be generally referred to as simply "display units of the disclosure"), a first color emitted from the first unit pixel may include red, a second color emitted from the second unit pixel may include green, a third color emitted from the third unit pixel may include blue, and a fourth color emitted from the fourth unit pixel may include one of white, yellow, cyan, and magenta. In the case where one pixel is configured of three unit pixels, the arrangement of the unit pixels may include a delta arrangement and a pseudo-delta arrangement. In the case where one pixel is configured of four unit pixels, the arrangement of the unit pixels may include a diagonal arrangement, a pseudo-diagonal arrangement, a rectangle arrangement, and a pseudo-rectangle arrangement. As the basic grayscale number N of one unit pixel, 4, 8, 16, and 32 may be, but not limitedly, exemplified.

In the display units of the disclosure for color display, one pixel is configured of three or four types of sub-pixels. In the first display mode of the display units according to the first embodiment of the disclosure, J first unit pixels configure a first sub-pixel, J second unit pixels configure a second sub-pixel, J third unit pixels configure a third sub-pixel, and in some case, J fourth unit pixels configure a fourth sub-pixel. In the second display mode thereof, j first unit pixels configure a first sub-pixel, j second unit pixels configure a second sub-pixel, j third unit pixels configure a third sub-pixel, and in some case, j fourth unit pixels configure a fourth sub-pixel.

In the first display mode of the display units according to the second embodiment of the disclosure, $4^p$ first unit pixels configure a first sub-pixel, $4^p$ second unit pixels configure a second sub-pixel, $4^p$ third unit pixels configure a third sub-pixel, and $4^p$ fourth unit pixels configure a fourth sub-pixel. In the second display mode thereof, $4^{p'}$ first unit pixels configure a first sub-pixel, $4^{p'}$ second unit pixels configure a second sub-pixel, $4^{p'}$ third unit pixels configure a third sub-pixel, and $4^{p'}$ fourth unit pixels configure a fourth sub-pixel.

Furthermore, in the first display mode of the display units according to the third embodiment of the disclosure, 3×q first unit pixels configure a first sub-pixel, 3×q second unit pixels configure a second sub-pixel, and 3×q third unit pixels configure a third sub-pixel. In the second display mode thereof, q' first unit pixels configure a first sub-pixel, q' second unit pixels configure a second sub-pixel, and q' third unit pixels configure a third sub-pixel.

In a usable type of image display, switching between the first display mode and the second display mode is performed in the entire image display region of the display unit. In another usable type of image display, switching between the first display mode and the second display mode is performed in part of the image display region (for example, a lower side of the image display region) of the display unit, and image display in the first display mode or in the second display mode is normally performed in the remaining part of the image display region. In still another usable type of image display, image display in the first display mode is normally performed in part of the image display region of the display unit, while image display in the second display mode is normally performed in the remaining part of the image display region. In still another usable type of image display, image display in one of the first and second display modes is performed in part of the image display region of the display unit, and image display in the other display mode is performed in the remaining part of the image display region, while the display modes are switched from each other as desired. Image display corresponding to image signals may be prevented at an edge portion of the image display region of the display unit depending on a configuration of one pixel. In other words, a unit pixel that does not belong to any one pixel may occur at the edge portion of the image display region. In such a case, non-display processing (for example, processing of inputting a luminance signal "0" to a unit pixel) is appropriately performed to the unit pixel that is prevented from performing image display corresponding to image signals (the unit pixel that does not belong to any one pixel).

The display units of the disclosure are applicable for various image display units including a so-called desktop personal computer, a notebook personal computer, a mobile computer, a personal digital assistant (PDA), a mobile phone, a game machine, an electronic book, an electronic notebook, an electronic paper such as an electronic newspaper, a signboard, a poster, a sign, a bulletin board such as a blackboard, a copier, a printer sheet-replacing rewritable paper, a calculator, a display section or a housing of a household electric appliance, a display section of a discount card, electronic advertisement, electronic POP, etc.

Example 1

Example 1 relates to the display units according to the first and second embodiments of the present disclosure, the electronic apparatus of the disclosure, and the method of driving a display unit of the disclosure. An arrangement state of unit pixels showing one pixel in the first display mode and an arrangement state of unit pixels showing one pixel in the second display mode of the display unit of the Example 1 are illustrated in FIGS. 1A and 1B, FIGS. 2A and 2B, FIGS. 3A and 3B, FIGS. 4A and 4B, or FIGS. 5A and 5B, respectively.

To describe the display unit of the Example 1 or Example 2 described later based on the display unit according to the first embodiment of the disclosure, the display unit of the Example 1 or 2 includes a plurality of pixels arranged in a two-dimensional matrix, wherein an image is displayed in a first display mode and a second display mode, in the first display mode, one pixel is configured of a set including J (where J is an integer of 2 or more) first unit pixels emitting a first color, J second unit pixels emitting a second color, and J third unit pixels emitting a third color, and image display is performed through control of operation of each of the unit pixels (see FIGS. 1A, 2A, 3A, 4A, 6A, 7A, 8A, 9A, 10A, 11, and 13A), and in the second display mode, one pixel is configured of a set including j (where j is an integer of 1 or more and less than J) first unit pixels, j second unit pixels, and j third unit pixels, and image display is performed through control of operation of each of the unit pixels (see FIGS. 1B, 2B, 3B, 4B, 6B, 7B, 8B, 9B, 10B, 12, and 13B).

In the Example 1, in the first display mode, one pixel is configured of a set of J first unit pixels, J second unit pixels, J third unit pixels, and J fourth unit pixels emitting a fourth color, and image display is performed through control of operation of each of the unit pixels. In the second display mode, one pixel is configured of a set of j first unit pixels, j second unit pixels, j third unit pixels, and j fourth unit pixels, and image display is performed through control of operation of each of the unit pixels. In addition, grayscale control is performed through control of operation of each of the unit pixels in the first display mode, while image display with a higher image resolution than that in the first display mode is performed in the second display mode.

To describe the display unit of the Example 1 based on the display unit according to the second embodiment of the disclosure, the display unit of the Example 1 includes a plurality of pixels arranged in a two-dimensional matrix, wherein an image is displayed in a first display mode and a second display mode, in the first display mode, one pixel is configured of a set of $4^p$ (where p is an integer of 1 or more) first unit pixels emitting a first color, $4^p$ second unit pixels emitting a second color, $4^p$ third unit pixels emitting a third color, and $4^p$ fourth unit pixels emitting a fourth color, and image display is performed through control of operation of each of the unit pixels, and in the second display mode, one pixel is configured of a set of $4^{p'}$ (where p' is an integer of (p−1) or less) first unit pixels, $4^{p'}$ second unit pixels, $4^{p'}$ third unit pixels, and $4^{p'}$ fourth unit pixels, and image display is performed through control of operation of each of the unit pixels.

Grayscale control is performed through control of operation of each of the unit pixels in the first display mode. Image display with an image resolution $4^{p-p'}$ times as high as that in the first display mode is performed in the second display mode. Furthermore, as illustrated in FIG. 1A, 2A, or 3A, the $4^p$ first unit pixels in the first display mode occupy a first quadrant of one pixel in the first display mode while being arranged in $2^p \times 2^p$, the $4^p$ second unit pixels in the first display mode occupy a second quadrant of one pixel in the first display mode while being arranged in $2^p \times 2^p$, the $4^p$ third unit pixels in the first display mode occupy a third quadrant of one pixel in the first display mode while being arranged in $2^p \times 2^p$, the $4^p$ fourth unit pixels in the first display mode occupy a fourth quadrant of one pixel in the first display mode while being arranged in $2^p \times 2^p$, and p'=(p−1) is satisfied.

In the first display mode of the display unit of the Example 1, J first unit pixels configure a first sub-pixel, J second unit pixels configure a second sub-pixel, J third unit pixels configure a third sub-pixel, and J fourth unit pixels configure a fourth sub-pixel. In the second display mode thereof, j first unit pixels configure a first sub-pixel, j second unit pixels configure a second sub-pixel, j third unit pixels configure a third sub-pixel, and j fourth unit pixels configure a fourth sub-pixel.

Alternatively, in the first display mode thereof, $4^p$ first unit pixels configure a first sub-pixel, $4^p$ second unit pixels configure a second sub-pixel, $4^p$ third unit pixels configure a third sub-pixel, and $4^p$ fourth unit pixels configure a fourth sub-pixel. In the second display mode thereof, $4^{p'}$ first unit pixels configure a first sub-pixel, $4^{p'}$ second unit pixels configure a second sub-pixel, $4^{p'}$ third unit pixels configure a third sub-pixel, and $4^{p'}$ fourth unit pixels configure a fourth sub-pixel.

In the Example 1 or Example 2 described later, the display unit is an electrophoretic display unit configuring an electronic paper, for example. The electrophoretic display unit has memory performance, and is thus capable of holding a displayed image without continuous application of a voltage or current, thereby leading to low power consumption. While various types or formats of image display exist for the electrophoretic display unit, the electrophoretic display unit is a diffused-reflection-type display unit without any illumination device, and the image display region thereof has a property of diffusively reflecting incident light. The first color emitted by the first unit pixel is red, the second color emitted by the second unit pixel is green, the third color emitted by the third unit pixel is blue, and the fourth color emitted by the fourth unit pixel is white. Specifically, for example, the first unit pixel may have a red color filter, the second unit pixel may have a green color filter, the third unit pixel may have a blue color filter, and the fourth unit pixel may have no color filter. When the color filters are assumed to be removed from the first, second, and third unit pixels, the unit pixels each have the same configuration as that of the fourth unit pixel. While light is somewhat absorbed by the color filter after passing through the color filter, and thus brightness of an image is reduced, such a reduction in brightness of an image is suppressed by providing the fourth unit pixels emitting white light. The unit pixels are arranged, but not limitedly, in a diagonal or rectangle arrangement.

Table 1 shows a relationship between values of p and p' in the display units illustrated in FIGS. 1A, 2A, 3A, 4A, and 5A.

TABLE 1

| | FIG. 1/FIG. 2/FIG. 5 | FIG. 3 | FIG. 4 |
|---|---|---|---|
| P | 1 | 2 | 2 |
| p' | 0 | 1 | 0 |
| p − p' | 1 | 1 | 2 |
| $4^p$ | 4 | 16 | 16 |
| $4^{p'}$ | 1 | 4 | 1 |
| $4^{p-p'}$ | 4 | 4 | 16 |

Specifically, in the display unit of the Example 1 illustrated in FIGS. 1A and 1B, 4 first unit pixels in the first display mode occupy a first quadrant of one pixel in the first display mode while being arranged in 2×2. In addition, 4 second unit pixels in the first display mode occupy a second quadrant of one pixel in the first display mode while being arranged in 2×2, 4 third unit pixels in the first display mode occupy a third quadrant of one pixel in the first display mode while being arranged in 2×2, and 4 fourth unit pixels in the first display mode occupy a fourth quadrant of one pixel in the first display mode while being arranged in 2×2. On the other hand, in the second display mode, p'=(p−1)=0 is satisfied, and thus one pixel is configured of a set of $4^{p'}=4^0=1$ first unit pixel, 1 second unit pixel, 1 third unit pixel, and 1 fourth unit pixel, and image display is performed through control of operation of each of the unit pixels. In the first display mode, 4 first unit pixels, 4 second unit pixels, 4 third unit pixels, and 4 fourth unit pixels are into a diagonal or rectangle arrangement to configure one pixel. On the other hand, in the second display mode, 1 first unit pixel, 1 second unit pixel, 1 third unit pixel, and 1 fourth unit pixel are into a diagonal or rectangle arrangement to configure one pixel.

In the display unit of the Example 1 illustrated in FIGS. 2A and 2B, p=1 and p'=0 are given. In the first display mode, a set is thus configured of 1 first unit pixel, 1 second unit pixel, 1 third unit pixel, and 1 fourth unit pixel, and four of such sets are clustered into a diagonal or rectangle arrangement to configure one pixel. On the other hand, in the second display mode, 1 first unit pixel, 1 second unit pixel, 1 third unit pixel, and 1 fourth unit pixel are into a diagonal or rectangle arrangement to configure one pixel.

In each of the exemplary cases illustrated in FIGS. 1A and 1B and FIGS. 2A and 2B, a combination (J, j) is (4, 1). When a basic grayscale number N of one unit pixel is "4", the following is established in the first display mode:

$$\text{pseudo-grayscale number} = J \times (N-1) + 1 = 13.$$

In the second display mode, the following is established:

$$\text{pseudo-grayscale number} = j \times (N-1) + 1 = 4.$$

When image resolution in the first display mode is "1", image resolution in the second display mode is "4". Hereinafter, description is made assuming that the basic grayscale number N of one unit pixel is "4".

Furthermore, in the display unit of the Example 1 illustrated in FIGS. 3A and 3B, $2^2 \times 2^2 = 16$ first unit pixels in the first display mode occupy a first quadrant of one pixel in the first display mode while being arranged in $2^2 \times 2^2 = 4 \times 4$. In addition, 16 second unit pixels in the first display mode occupy a second quadrant of one pixel in the first display mode while being arranged in 4×4, 16 third unit pixels in the first display mode occupy a third quadrant of one pixel in the first display mode while being arranged in 4×4, and 16 fourth unit pixels in the first display mode occupy a fourth quadrant of one pixel in the first display mode while being arranged in 2×2. On the other hand, in the second display mode, p'=(p−1)=1 is given, and thus one pixel is configured of a set of $4^{p'} = 4^1 = 4$ first unit pixels, 4 second unit pixels, 4 third unit pixels, and 4 fourth unit pixels, and image display is performed through control of operation of each of the unit pixels. In the first display mode, 16 first unit pixels, 16 second unit pixels, 16 third unit pixels, and 16 fourth unit pixels are into a diagonal or rectangle arrangement to configure one pixel. On the other hand, in the second display mode, 4 first unit pixels, 4 second unit pixels, 4 third unit pixels, and 4 fourth unit pixels are into a diagonal or rectangle arrangement to configure one pixel.

In the exemplary case illustrated in FIGS. 3A and 3B, a combination (J, j) is (16, 4); hence, the following is established:

$$\text{pseudo-grayscale number} = J \times (N-1) + 1 = 49.$$

In the second display mode, the following is established:

$$\text{pseudo-grayscale number} = j \times (N-1) + 1 = 13.$$

When image resolution in the first display mode is "1", image resolution in the second display mode is "4".

Furthermore, in the display unit of the Example 1 illustrated in FIGS. 4A and 4B, $2^2 \times 2^2 = 16$ first unit pixels in the first display mode occupy a first quadrant of one pixel in the first display mode while being arranged in $2^2 \times 2^2 = 4 \times 4$. In addition, 16 second unit pixels in the first display mode occupy a second quadrant of one pixel in the first display mode while being arranged in 4×4, 16 third unit pixels in the first display mode occupy a third quadrant of one pixel in the first display mode while being arranged in 4×4, and 16 fourth unit pixels in the first display mode occupy a fourth quadrant of one pixel in the first display mode while being arranged in 4×4. On the other hand, in the second display mode, p'=(p−2)=0 is given, and thus one pixel is configured of a set of $4^{p'} = 4^0 = 1$ first unit pixel, 1 second unit pixel, 1 third unit pixel, and 1 fourth unit pixel, and image display is performed through control of operation of each of the unit pixels. In the first display mode, a set is configured of 4 first unit pixels, 4 second unit pixels, 4 third unit pixels, and 4 fourth unit pixels, and four of such sets are clustered into a diagonal or rectangle arrangement to configure one pixel. On the other hand, in the second display mode, 1 first unit pixel, 1 second unit pixel, 1 third unit pixel, and 1 fourth unit pixel are into a diagonal or rectangle arrangement to configure one pixel.

In the exemplary case illustrated in FIGS. 4A and 4B, a combination (J, j) is (16, 1); hence, the following is established:

$$\text{pseudo-grayscale number} = J \times (N-1) + 1 = 49.$$

In the second display mode, the following is established:

$$\text{pseudo-grayscale number} = j \times (N-1) + 1 = 4.$$

When image resolution in the first display mode is "1", image resolution in the second display mode is "16".

As described hereinbefore, image resolution in the first display mode is different from image resolution in the second display mode. Hence, it is preferable that an image is relatively reduced in the first display mode, while being relatively expanded in the second display mode. In other words, the image resolution is decreased in the first display mode while being increased in the second display mode. Such relative reduction and relative expansion of an image may be performed based on a known technique, specifically, a thinning process of an image signal or an interpolation process, for example. For example, an image desired to have a large grayscale number such as a photographic image should be displayed based on the first display mode, and an image desired to have high definition such as a letter image should be displayed based on the second display mode. The same holds true in the Example 2 described later.

The electronic apparatus of the Example 1 includes the above-described display unit of the Example 1.

In the method of driving a display unit of the Example 1 or Example 2 described later, the display unit includes a plurality of pixels arranged in a two-dimensional matrix, in which an image is displayed in a first display mode and a second display mode, in the first display mode, one pixel is configured of a set including J (where J is an integer of 2 or more) first unit pixels emitting a first color, J second unit pixels emitting a second color, and J third unit pixels emitting a third color, and image display is performed through control of operation of each of the unit pixels, and in the second display mode, one pixel is configured of a set including j (where j is an integer of 1 or more and less than J) first unit pixels, j second unit pixels, and j third unit pixels, and image display is performed through control of operation of each of the unit pixels, and the first display mode and the second display mode are switched from each other based on a mode switching signal that allows the first display mode and the second display mode to be switched from each other.

The display unit should have a mode switcher (specifically, for example, a switch) for switching a mode between the first display mode and the second display mode. This allows a user of the display unit to switch the first display mode and the second display mode from each other through operating the mode switcher. In another usable configuration, when the display unit receives an external mode switching signal that allows the first display mode and the second display mode to be switched from each other, a display mode is switched to the first or second display mode based on the mode switching signal. The mode switching signal may be sent to the display unit together with an image signal for image display on the display unit, or may be sent to the display unit separately form the image signal for image display on the display unit.

Figure 15:
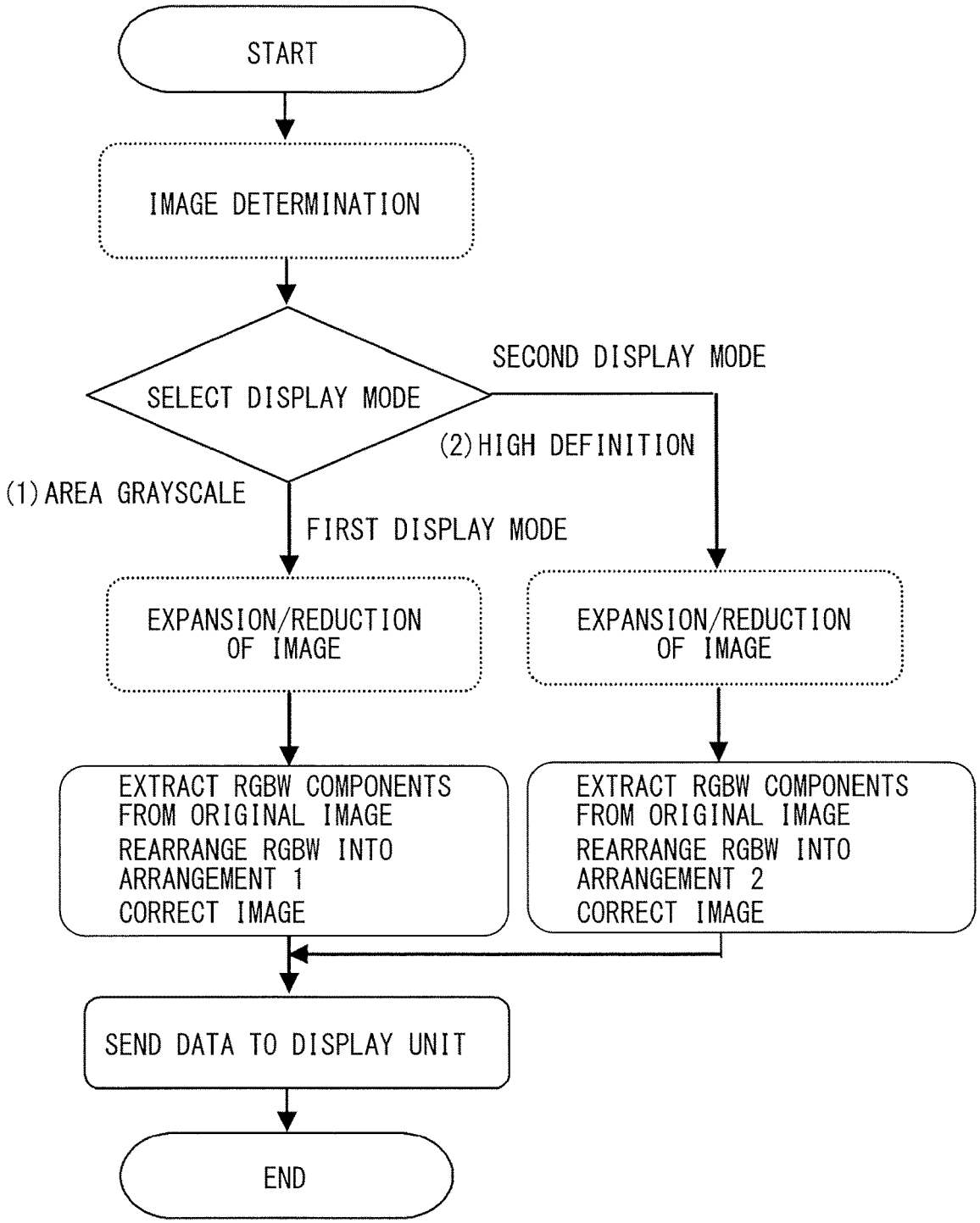
FIG. 15 is a flowchart for explaining a method of driving the display unit of the Example 1.

Alternatively, as illustrated in a flowchart of FIG. 15, whether an image is displayed in the first display mode or in the second display mode may be determined based on an image to be displayed. Such determination may be performed within the display unit or may be performed in an external unit such as a personal computer or a server. Specifically, for example, processing such as edge detection is performed on an original image to be displayed, and whether the image is a photographic image or a letter information image is determined based on the number of edges (image determination) for automatic switching of a display mode. The same holds true in the Example 2 described later.

Figure 14A:
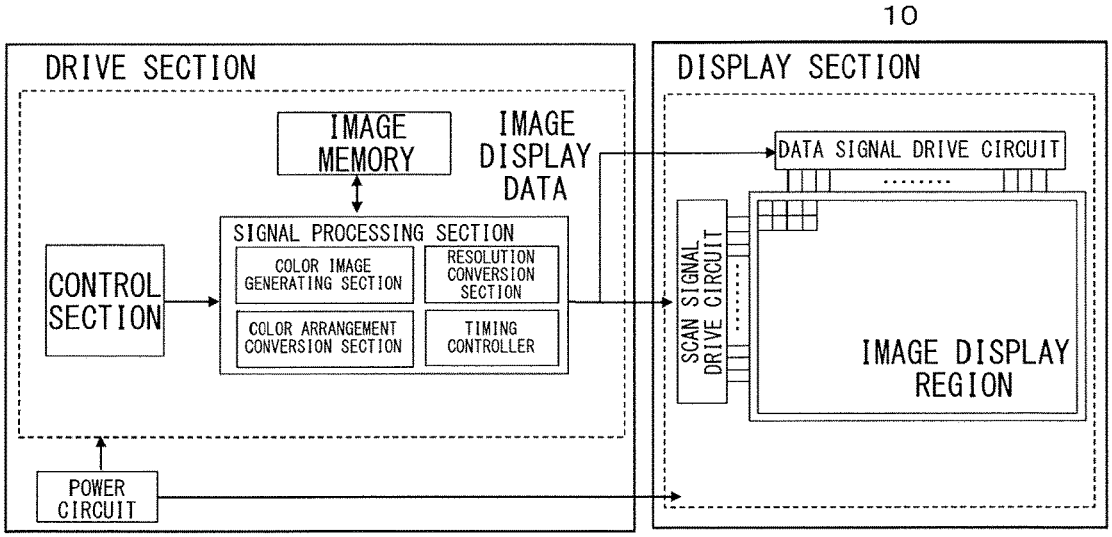
FIGS. 14A and 14B are conceptual diagrams of a display unit in a type where calculation of a display image and calculation of pixel arrangement are performed within the display unit, and a display unit in a type where calculation of a display image and calculation of pixel arrangement are performed in an external personal computer or server, and converted image data are sent to the display unit, respectively.
Figure 14B:
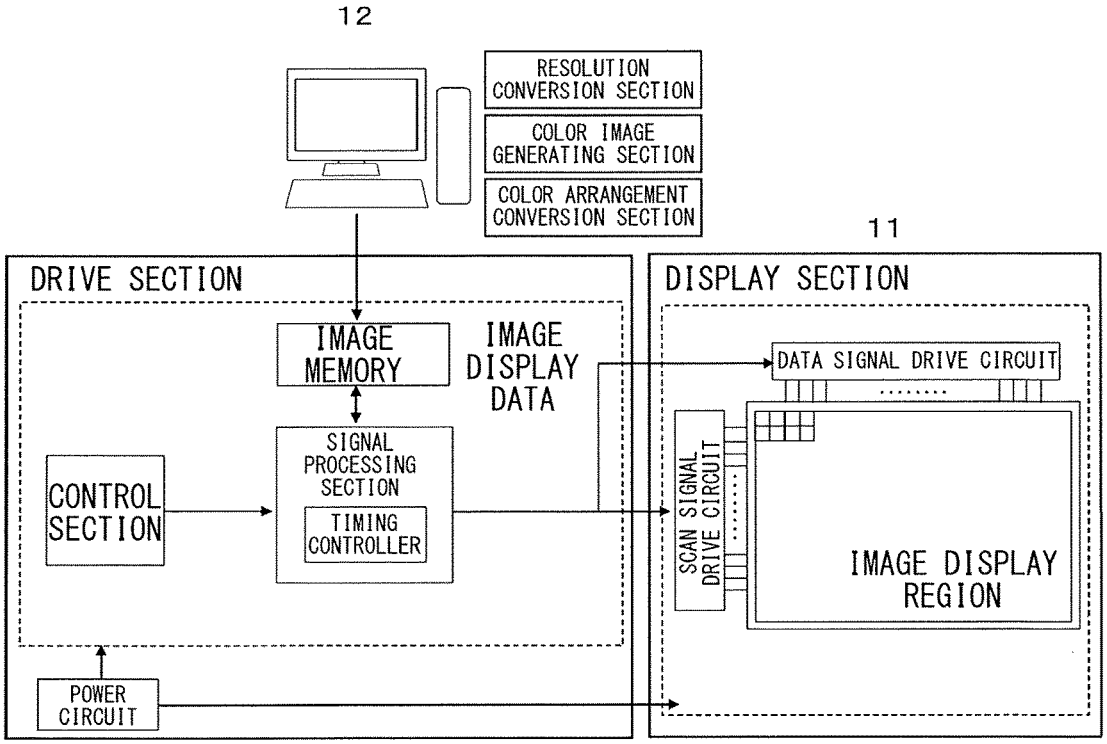

FIG. 14A illustrates a conceptual diagram of a display unit 10 in a type where calculation of a display image and calculation of pixel arrangement are performed within the display unit, in which a drive circuit configured to drive a unit pixel may be configured of an active-matrix drive circuit having TFT or a passive-matrix drive circuit. The display unit 10 illustrated in FIG. 14A is configured of a display section and a drive section. For example, the display section may be configured of an image display region, a data signal drive circuit, and a scan signal drive circuit. For example, the drive section may be configured of an image memory, a signal processing section, a control section, and a power circuit. For example, the signal processing section may be configured of a color image generating section, a resolution conversion section, a color arrangement conversion section, and a timing controller. Alternatively, as illustrated in FIG. 14B, calculation of a display image and calculation of pixel arrangement may be performed in an external personal computer 12 or server while converted image data are sent to a display unit 11. A mode switching signal is preferably sent together with the image data from the external personal computer 12 or server. A drive circuit configured to drive a unit pixel may be configured of an active-matrix drive circuit having TFT or a passive-matrix drive circuit. The display unit 11 illustrated in FIG. 14B is also configured of a display section and a drive section. For example, the display section may be configured of an image display region, a data signal drive circuit, and a scan signal drive circuit. For example, the drive section may be configured of an image memory, a signal processing section including a timing controller, a control section, and a power circuit. For example, the external personal computer 12 or server may include a color image generating section, a resolution conversion section, and a color arrangement conversion section. The same holds true in the Example 2 described later.

Switching between the first display mode and the second display mode may be performed in the entire image display region of the display unit, or may be performed in part of the image display region (for example, a lower side of the image display region) of the display unit. This allows text broadcasting, a subtitle, a telop, clock display, etc. to be displayed in a high resolution mode in the lower side of the image display region, for example.

Figure 5B:
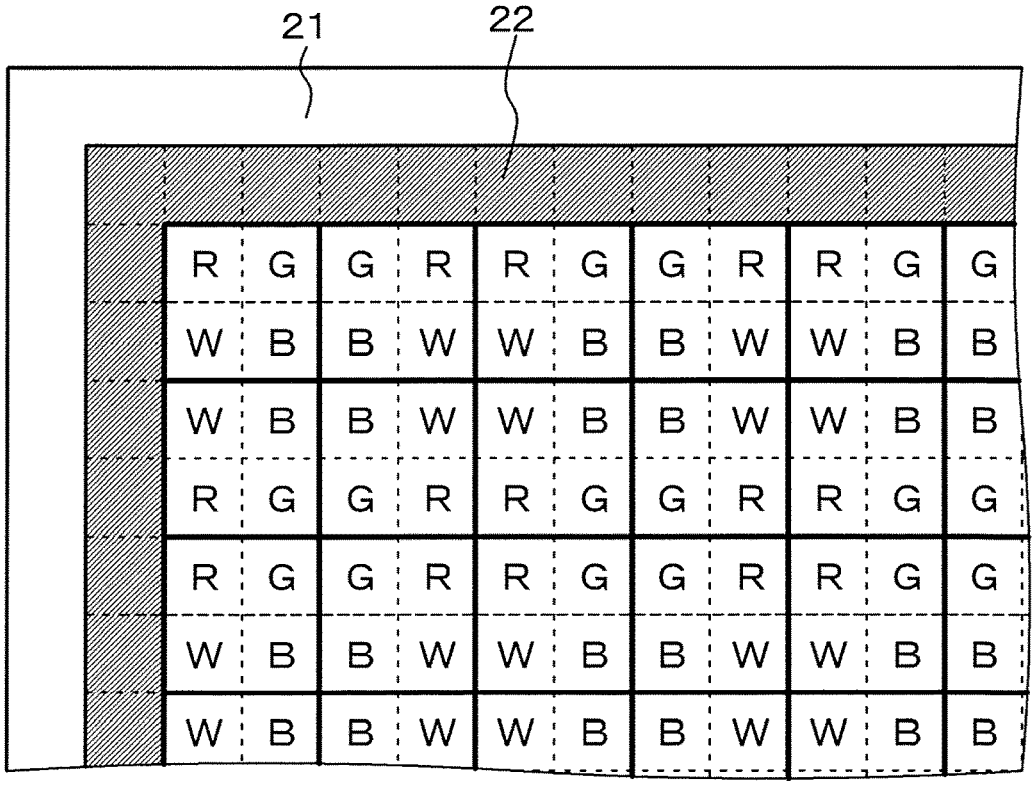

Image display corresponding to image signals may be prevented at an edge portion of the image display region of the display unit depending on a configuration of one pixel. In such a case, as shown in FIGS. 5A and 5B illustrating a Modification of the display unit illustrated in FIGS. 1A and 1B, non-display processing (for example, processing of inputting a luminance signal "0" to a unit pixel 22) is appropriately performed to such a unit pixel 22 that is prevented from performing image display corresponding to image signals, i.e., does not belong to any one pixel. It is to be noted that the reference numeral 21 refers to a frame of a display section configuring the display unit.

As described above, in the Example 1, in the first display mode, one pixel is configured of a set of a first number of first unit pixels, second unit pixels, third unit pixels, and fourth unit pixels, and image display is performed through control of operation of each of the unit pixels. In the second display mode, one pixel is configured of a set of a second number, which is smaller than the first number, of first unit pixels, second unit pixels, third unit pixels, and fourth unit pixels, and image display is performed through control of operation of each of the unit pixels. Hence, it is possible to perform image display with a large grayscale number in the first display mode, and perform high-definition image display in the second display mode. Specifically, it is possible to provide a display unit capable of performing image display with a large grayscale number and/or performing high-definition image display, as desired. It is therefore possible to provide a display unit capable of performing two types of display, i.e., display with improved display performance due to an increase in grayscale number based on the area grayscale method and display causing no reduction in image definition, and allowing optimal display for both of an image desired to have a grayscale number such as a photographic image, and a high-definition image such as a letter image.

In the case where the display unit is an electrophoretic display unit, for example, the electrophoretic display unit may include two substrates (first and second substrates) opposed to each other, electrodes (first and second electrodes) provided on the respective substrates, and an electrophoretic dispersion liquid enclosed between the two substrates.

Light is assumed to be emitted from the second substrate for convenience.

For example, the electrophoretic dispersion liquid is configured of a large number of charged electrophoretic particles and a dispersion medium having a color different from a color of each electrophoretic particle. The first electrode and the second electrode are appropriately disposed in one unit pixel. Thus, when the electrophoretic particles are negatively charged, and when a relatively negative voltage is applied to the first electrode while a relatively positive voltage is applied to the second electrode, the negatively charged electrophoretic particles migrate so as to cover the second electrode. As a result, the electrophoretic display unit has a high light reflectance value while having a low light transmittance value. Conversely, when a relatively positive voltage is applied to the first electrode while a relatively negative voltage is applied to the second electrode, the electrophoretic particles migrate so as to cover the first electrode. As a result, the electrophoretic display unit has a low light reflectance value while having a high light transmittance value. Such voltage application to each electrode makes it possible to perform control of the light reflectance or the light transmittance of the electrophoretic display unit. The voltage may be DC voltage or AC voltage. The first electrode should be patterned to be shaped such that when the electrophoretic particles migrate so as to cover the first electrode so that the electrophoretic display unit has a low light reflectance value or a high light transmittance value, uniformity is achieved over values of the light reflectance or the light transmittance of the electrophoretic display unit. The shape of the patterned first electrode is determined through various examinations.

One of the two opposed substrates may be referred to as "first substrate" for convenience, while the other substrate opposed to the first substrate may be referred to as "second substrate" for convenience. The patterned or unpatterned electrode provided on the first substrate may be referred to as "first electrode" for convenience as necessary, while the patterned or unpatterned electrode provided on the second substrate may be referred to as "second electrode" for convenience as necessary. Each of the first and second substrates may include an insulating component such as a glass substrate or a plastic substrate. Specifically, such a substrate may include a transparent inorganic substrate including quartz, sapphire, and glass, and a transparent plastic substrate including polyethylene terephthalate, polyethylene naphthalate, polycarbonate, polyether sulfone, polystyrene, polyethylene, polypropylene, polyphenylene sulfide, polyvinylidene fluoride, tetraacetyl cellulose, brominated phenoxy, aramids, polyimides, polystyrenes, polyarylates, polysulfones, polyolefins, etc. In the case where each of the first and second substrates is configured of a transparent plastic substrate, a barrier layer including an inorganic or organic material may be beforehand provided on the inner surface of the substrate. Examples of the thickness of the substrate may include 2 μm to 5 mm both inclusive, and preferably 5 μm to 1 mm both inclusive. An excessively thin substrate makes it difficult to maintain strength of the substrate and a uniform interval between the substrates. On the other hand, an excessively thick substrate causes degradation in display function such as clearness and contrast. In particular, such a thick substrate may cause insufficient flexibility in electronic paper use.

Each of the first and second electrodes may include, but not limited to, a so-called transparent electrode that specifically includes indium-tin composite oxides (including indium tin oxide (ITO), Sn-doped $In_2O_3$, crystalline ITO, and amorphous ITO), fluorine-doped $SnO_2$ (FTO), F-doped $In_2O_3$ (IFO), antimony-doped $SnO_2$ (ATO), $SnO_2$, ZnO (including Al-doped ZnO and B-doped ZnO), indium-zinc composite oxides (indium zinc oxide (IZO)), spinel-type oxides, oxides having a $YbFe_2O_4$ structure, conductive polymers such as polyaniline, polypyrrole, and polythiophene, etc. Two or more of them may be used in combination. In some case, the first electrode may be configured not only of the material configuring the transparent electrode, but also of metal such as gold, silver, copper, and aluminum or an alloy thereof, or may be configured of a black electrode material layer (specifically, a titanium carbide layer, a blackened chromium layer, an aluminum layer having a black layer on its surface, and a titanium black layer, for example). Each of the first and second electrodes may be formed by a physical vapor deposition process (PVD process) such as a vacuum evaporation process and a sputtering process, any of various chemical vapor deposition processes (CVD processes), or any of various coating processes. The electrode may be patterned by any of processes such as an etching process, a liftoff process, and processes using various masks.

An insulating layer may be provided on the substrate as necessary. Examples of a material configuring such an insulating layer may include a colorless and transparent insulative resin, specifically, acrylic resin, epoxy resin, fluorine resin, silicone resin, polyimide resin, and polystyrene resin, for example. Fine particles for light scattering, such as particles of aluminum oxide or titanium oxide, may be added to the colorless and transparent insulative resin configuring the insulating layer.

In the case where no electrode is provided on the substrate, an electrostatic latent image is provided on an outer surface of the substrate, and the electrophoretic particles are attracted to or repelled from the substrate by an electric field generated according to the electrostatic latent image, and therefore the electrophoretic particles are arranged corresponding to the electrostatic latent image, and such arranged electrophoretic particles are viewed through the second transparent substrate. The electrostatic latent image may be formed by a formation process of an electrostatic latent image performed in a typical electrophotographic system using an electrophotographic photoreceptor. Alternatively, the electrostatic latent image may be directly formed on the substrate with ion flow. On the other hand, in the case where an electrode is provided on the substrate, the electrophoretic particles charged in a desired property are attracted to or repelled from the electrode based on an electric field generated by application of a DC or AC voltage to the electrode, thereby allowing the electrophoretic particles to be viewed through the second transparent substrate. The electrode or a wiring is preferably provided on each of the first and second substrates, or a switching device (for example, a thin film transistor (TFT)) is preferably provided on the first substrate in order to control the application of the voltage to the electrode.

Examples of a proportion of the electrophoretic particles relative to the dispersion liquid (dispersion medium) in the electrophoretic dispersion liquid may include 0.1 parts by mass to 15 parts by mass both inclusive, preferably 1 part by mass to 10 parts by mass both inclusive, of the electrophoretic particles relative to 100 parts by mass of the dispersion liquid (dispersion medium).

The dispersion liquid (dispersion medium) for dispersion of the electrophoretic particles may include a highly insulative, colorless and transparent liquid that specifically includes a nonpolar dispersion medium, more specifically water; alcohol-based dispersion media such as methanol, ethanol, isopropanol, butanol, octanol, and methyl cellosolve; various ester dispersion media such as ethyl acetate and butyl acetate; ketone dispersion media such as acetone, methyl ethyl ketone, and methyl isobutyl ketone; aliphatic hydrocarbon; aromatic hydrocarbon; halogenated hydrocarbon such as methylene chloride, chloroform, carbon tetrachloride, and 1,2-dichloroethane; carboxylate; silicone oil, etc. The aliphatic hydrocarbon may include pentane, hexane, cyclohexane, heptane, octane, nonane, decane, dodecane, ligroin, solvent naphtha, kerosene, normal paraffin, isoparaffin, etc. The aromatic hydrocarbon may include benzene, toluene, xylene, hexylbenzene, heptylbenzene, octylbenzene, nonylbenzene, decylbenzene, undecylbenzene, dodecylbenzene, tridecylbenzene, tetradecylbenzene, alkyl benzene, cyclohexane, methyl cyclohexane, etc. The silicone oil may include various types of dimethyl polysiloxane including modified silicone oils. Specifically, the silicone oil may include Isopar G, H, L, M, and Exsol D30, D40, D80, D110, D130 from Exxon Mobil Corporation, IP SOLVENT 1620, 2028, 2835 from Idemitsu Petrochemical Co., Ltd., Shellsol 70, 71, 72, A, AB from Shell Chemicals Japan, Ltd., Naphtesol L, M, H from Nippon Oil Co., Ltd., etc. Such silicone oils may be used alone or in a mixture of two or more of them. An oil soluble dyestuff may be used for coloring of the dispersion medium. Specific examples of the oil soluble dyestuff may include yellow or orange dyestuffs including azo compounds, brown dyestuffs, red dyestuffs, blue or green dyestuffs including anthraquinones, and violet dyestuffs. Alternatively, compound dyestuffs such as diazo dyestuffs, amine dyestuffs, and diamine dyestuffs, natural dyes such as cochineal dyes and carminic acid dyes, organic pigments such as polyazo pigments, anthraquinone pigments, quinacridone pigments, isoindoline pigments, isoindolinone pigments, phthalocyanine pigments, and perylene pigments, inorganic pigments such as carbon black, silica, chromium oxide, iron oxide, titanium oxide, and zinc sulfide, etc., may be used. Such dyestuffs may be used alone or in a combination of two or more of them. The concentration of the dyestuff may be preferably, but not limited to, 0.1 parts by mass to 3.5 parts by mass both inclusive relative to 100 parts by mass of the dispersion medium.

Alternatively, the dispersion liquid (dispersion medium) configuring the electrophoretic dispersion liquid may include non-ionic surfactants such as sorbitan fatty acid ester (for example, sorbitan monooleate, sorbitan monolaurate, sorbitan sesquioleate, sorbitan trioleate, etc.); polyoxyethylene sorbitan fatty acid ester (for example, polyoxyethylene sorbitan monostearate, polyoxyethylene sorbitan monooleate, etc.); polyethylene glycol fatty acid ester (for example, polyoxyethylene monostearate, polyethylene glycol diisostearate, etc.); and polyoxyethylene alkylphenyl ether (for example, polyoxyethylene nonylphenyl ether, polyoxyethylene octylphenyl ether, etc.); and fatty acid diethanolamide. Examples of the polymer dispersant configuring the dispersion liquid (dispersion medium) may include styrene-maleic acid resin, styrene-acryl resin, rosin, urethane polymer compounds BYK-160, 162, 164, 182 (from Big Chemie Inc.), urethane dispersants EFKA-47 and LP-4050 (from EFKA), polyester polymer compounds Solspers 24000 (from Zeneca Co.), aliphatic diethanolamide polymer compounds Solspers 17000 (from Zeneca Co.), etc. Other polymer dispersants may include a monomer capable of forming a portion that is easily solvated in the dispersion medium, such as lauryl methacrylate, stearyl methacrylate, 2-ethylhexyl methacrylate, and cetyl methacrylate, a monomer capable of forming a portion that is not easily solvated in the dispersion medium, such as methyl methacrylate, ethyl methacrylate, isopropyl methacrylate, styrene, and vinyl toluene, a random copolymer of monomers having polar functional groups, and a graft copolymer as disclosed in Japanese Unexamined Patent Application Publication No. 3-188469, etc. The monomers having polar functional groups may include a monomer having an acid functional group such as acrylic acid, methacrylic acid, itaconic acid, fumaric acid, maleic acid, and styrenesulfonic acid; a monomer having a basic functional group such as dimethylamino ethyl methacrylate, diethylamino ethyl methacrylate, vinyl pyridine, vinyl pyrrolidine, vinyl piperidine, and vinyl lactam. The polymer dispersants may include salts thereof; styrene-butadiene copolymer, a block copolymer of styrene and long-chain alkyl methacrylate disclosed in Japanese Unexamined Patent Application Publication No. 60-10263, etc. A dispersant such as a graft copolymer disclosed in Japanese Unexamined Patent Application Publication No. 3-188469 may be added. The addition amount of the dispersant may include 0.01 parts by mass to 5 parts by mass both inclusive relative to 100 parts by mass of the electrophoretic particles. An ionic surfactant may be added in order to further effectively cause electrophoresis of the electrophoretic particles. Specific examples of anionic surfactants may include sodium dodecylbenzenesulfonate, sodium dodecyl sulfate, sodium alkylnaphthalene sulfonate, dialkyl sodium sulfosuccinate, etc. Specific examples of cationic surfactants may include alkylbenzene dimethyl ammonium chloride, alkyl trimethyl ammonium chloride, distearyl ammonium chloride, etc. An ionic additive soluble in a nonpolar dispersant, such as a trifluorosulfonylimide salt, trifluoro acetate, and trifluoro sulfate, may be added. The addition amount of the ionic additive may include 1 part by mass to 10 parts by mass both inclusive relative to 100 parts by mass of the electrophoretic particles.

Examples of the electrophoretic particles may include black pigments such as aniline black and carbon black; white pigments such as titanium dioxide, zinc white, and antimony trioxide; yellow pigments such as azo pigments, isoindolinone, chrome yellow, yellow iron oxide, cadmium yellow, titanium yellow, and antimony; red pigments such as azo pigments, quinacridone red, and chrome vermilion; blue pigments such as phthalocyanine blue, indanthrene blue, anthraquinone pigments, iron blue, ultramarine blue, and cobalt blue; green pigments such as phthalocyanine green; various types of metal oxide; phthalocyanine dyes (cyan); direct blue 199 (project cyan); magenta 377 (magenta); reactive red 29 (magenta); reactive red 180 (magenta); and azo dyes (yellow dyes such as yellow 104, Ilford AG, Rue de l'Industrie, CH-1700 Fribourg, Switzerland).

A structure where the electrophoretic dispersion liquid is contained in a microcapsule may be used. The microcapsule may be provided by a well-known process such as an interfacial polymerization process, an in-situ polymerization process, a coacervation process, a phase separation process, an interfacial precipitation process, and a spray drying process. A material configuring the microcapsule is desired to have a property of sufficiently transmitting light. Specific examples of the material may include urea-formaldehyde resin, polyuria resin, urea resin, melamine resin, melamine-formaldehyde resin, polyester resin, acrylic resin, polyurethane resin, polyamide resin, polyethylene resin, polystyrene resin, polyvinyl alcohol resin, gelatin, copolymers thereof, etc. Examples of a method of disposing the microcapsule on a substrate may include various coating processes such as an inkjet method, a roll coater process, a roll laminator process, a screen printing process, and a spray process without limitation. The size (average grain size) of the microcapsule may be preferably, but not limited to, about 10 μm to 150 μm both inclusive, and more preferably about 30 μm to 100 μm both inclusive.

The microcapsule may be fixed on the substrate with a light-transmissive resin binder in order to prevent displacement of the microcapsule disposed on the substrate. The light-transmissive resin binder may include aqueous polymer. Specific examples of the aqueous polymer may include polyvinyl alcohol, polyurethane, polyester, acrylic resin, silicone resin, etc. Alternatively, the resin configuring the binder may include thermoplastic resin such as polyethylene, chlorinated polyethylene, ethylene-vinyl acetate copolymer, ethylene-ethyl acrylate copolymer, polypropylene, ABS resin, methyl methacrylate resin, vinyl chloride resin, vinyl chloride-vinyl acetate copolymer, vinyl chloride-vinylidene chloride copolymer, vinyl chloride-acrylic acid ester copolymer, vinyl chloride-methacrylic acid ester copolymer, vinyl chloride-acrylonitrile copolymer, ethylene-vinyl alcohol-vinyl chloride copolymer, propylene-vinyl chloride copolymer, vinylidene chloride resin, vinyl acetate resin, polyvinyl formal, and cellulose resin; polyamide resin; polymers such as polyacetal, polycarbonate, polyethylene terephthalate, polybutylene terephthalate, polyphenylene oxide, polysulfone, polyamide-imide, polyaminobismaleimide, polyether sulfone, polyphenylene sulfone, polyarylate, grafted polyphenyleneether, polyether ether ketone, and polyether imide; fluorine resin such as polytetrafluoroethylene, poly(fluoroethylenepropylene), tetrafluoroethylene-perfluoroalcoxy ethylene copolymer, ethylene-tetrafluoroethylene copolymer, polyvinylidene fluoride, polytrifluorochloroethylene, and fluoro rubber; silicon resin such as silicone rubber; methacrylic acid-styrene copolymer, polybutylene, methacrylic acid methyl-butadiene-styrene copolymer, etc.

While a charge control agent is originally not necessary to be used for the electrophoretic particles, when a positive charge control agent is used to positively charge the electrophoretic particles, examples of the positive charge control agent may include nigrosine dyes such as Nigrosine Base EX (from Orient Chemical Industries Ltd.), quaternary ammonium salts such as P-51 (from Orient Chemical Industries Ltd.) and COPY CHARGE PX VP 435 (from Hoechst Japan Co., Ltd.), imidazole compounds such as alkoxyamine, alkylamide, a molybdenate chelate pigment and PLZ1001 (from SHIKOKU CHEMICALS Corp.), transparent or white onium compounds, etc. The onium compounds may freely selectively include primary to quaternary compounds including ammonium compounds, sulfonium compounds, and phosphonium compounds. In the onium compounds, for example, a substituent bonded to a nitrogen atom, a sulfur atom, or a phosphorous atom may be an alkyl or aryl group. In salts of the onium compounds, a counter ion may preferably, but not limitedly, include a halogen element typified by chlorine, a hydroxyl group, a carboxylic acid group, etc. In particular, primary to tertiary amine salts and quaternary ammonium salts are preferable. In the case where a negative charge control agent is used to negatively charge the electrophoretic particles, examples of the negative charge control agent may include metal complexes such as BONTRON S-22, BONTRON S-34, BONTRON E-81, and BONTRON E-84 (all from Orient Chemical Industry Co., Ltd), and Spiron Black TRH (from Hodogaya Chemical Co., Ltd); thioindigo pigments; quaternary ammonium salts such as Copy charge NX VP434 (from Hoechst Japan Co., Ltd.); calixarene compounds such as BONTRON E-89 (from Orient Chemical Industry Co., Ltd); boron compounds such as "LR147" (from Japan Carlit Co., Ltd); fluorine compounds such as magnesium fluoride and carbon fluoride; known metallic soaps such as aluminum monostearate, calcium stearate, aluminum laurate, barium laurate, sodium oleate, zirconium octylate, and cobalt naphthenate; and salicylic acid metal complexes and phenol condensates of azine compounds. The addition amount of the charge control agent may include 100 parts by mass to 300 parts by mass both inclusive relative to 100 parts by mass of the electrophoretic particles.

In the display unit, pixels or unit pixels (display cells) may be preferably separated by partitions. For example, rib-shaped partitions may be formed based on a photography technique using a photosensitive resin, or may be formed by any of various molding processes. The partitions may be formed together with one substrate, or may be formed together with each substrate so as to be then bonded to each other, or may be formed separately from the substrates so as to be then bonded to the substrates. The shape of the partition should be appropriately set based on size of the electrophoretic particle, etc. Examples of the width of the partition may include $1\times10^{-6}$ m to $1\times10^{-3}$ m both inclusive, and preferably $3\times10^{-6}$ m to $5\times10^{-4}$ m both inclusive. Examples of the height of the partition may include $1\times10^{-5}$ m to 5 mm both inclusive, and preferably $1\times10^{-5}$ m to 0.5 mm both inclusive. Examples of the planar shape of the pixel or the unit pixel enclosed by the partitions may include a quadrilateral, a triangle, a circle, a hexagon (honeycomb structure), etc. A linear shape may also be usable. The size of the pixel or unit pixel enclosed by the partitions should be determined based on a specification for the display unit. Examples of the length of one side of the pixel or unit pixel may include $1\times10^{-5}$ m to 5 mm both inclusive, and preferably $3\times10^{-5}$ m to 0.5 mm both inclusive. When the volume of the pixel or unit pixel enclosed by the partitions is "1", 0.1 to 0.8 both inclusive, preferably 0.1 to 0.7 both inclusive, may be exemplified as a volume ratio of the electrophoretic particles in the pixel or unit pixel enclosed by the partitions. The electrophoretic dispersion liquid may be filled by any of techniques without limitation, for example, may be filled by an inkjet method.

Alternatively, for example, the display unit may include the following display units in addition to the above-described type of electrophoresis display unit:

(A) a display unit in which electrophoretic particles and a porous layer formed of a fibrous structure are contained in an insulative liquid, and the fibrous structure contains non-electrophoretic particles having optical reflection characteristics different from those of the electrophoretic particles (see Japanese Unexamined Patent Application Publication Nos. 2012-022296 and 2012-173316), (B) a display unit of a type where white electrophoretic particles, black electrophoretic particles, and a fluid are contained in a microcapsule, and such electrophoretic particles are moved in the microcapsule by an electric field for white and black display, (C) a display unit of a type where white electrophoretic particles and black electrophoretic particles are moved by an electric field in the air rather than in a fluid, (D) a display unit in which light transmittance or light reflectance is controlled by an electrowetting phenomenon using a first liquid including alkane such as hexadecane or silicone oil, and a second liquid having electric conductivity or polarity, such as water or a salt solution (for example, a liquid including KCl dissolved in a mixed solution of water and ethylalcohol), (E) a twist ball type display unit using small balls as display elements, each of which has respective hemisphere faces colored in white and black, (F) a garden pea type display unit configured of a transparent hollow fiber and a display element enclosed within the transparent hollow fiber, G) a display unit using various types of liquid crystal such as polymer network liquid crystal, cholesteric liquid crystal, typical STN liquid crystal, and reflective liquid crystal, (H) a display unit using an anisotropic fluid and fine particles, (I) an electrodeposition (field deposition) type display unit using an electrodeposition/dissociation phenomenon caused by a reversible oxidation-reduction reaction of metal (for example, silver particles), and (J) a display unit using chromatic change of a substance generated through an oxidation-reduction reaction of an electrochromic material.

Example 2

Example 2 relates to the display units according to the first and third embodiments of the disclosure, the electronic apparatus of the disclosure, and the method of driving a display unit of the disclosure. An arrangement state of unit pixels showing one pixel in the first display mode and an arrangement state of unit pixels showing one pixel in the second display mode of the display unit of the Example 2 are schematically illustrated in FIGS. 6A and 6B, FIGS. 7A and 7B, FIGS. 8A and 8B, FIGS. 9A and 9B, FIGS. 10A and 10B, FIGS. 11 and 12, or FIGS. 13A and 13B, respectively.

To describe the display unit of the Example 2 based on the display unit according to the third embodiment of the disclosure, the display unit of the Example 2 includes a plurality of pixels arranged in a two-dimensional matrix, wherein an image is displayed in a first display mode and a second display mode, in the first display mode, one pixel is configured of a set of 3×q (where q is 1 or an even number) first unit pixels emitting a first color, 3×q second unit pixels emitting a second color, and 3×q third unit pixels emitting a third color, and image display is performed through control of operation of each of the unit pixels, and in the second display mode, q'=1 is given in the case of q=1, q'=1, 2, or 3 is given in the case of q=2, and q'=(3×q)/2 is given in the case of q being an even number of more than 2, and one pixel is configured of a set of q' first unit pixels, q' second unit pixels, and q' third unit pixels, and image display is performed through control of operation of each of the unit pixels.

To describe the display unit of the Example 2 based on the display unit according to the first embodiment of the disclosure, in the first display mode, one pixel is configured of a set of J first unit pixels, J second unit pixels, and J third unit pixels, and image display is performed through control of operation of each of the unit pixels. In the second display mode, one pixel is configured of a set of j first unit pixels, j second unit pixels, and j third unit pixels, and image display is performed through control of operation of each of the unit pixels. In addition, grayscale control is performed through control of operation of each of the unit pixels in the first display mode, while display with a higher image resolution than that in the first display mode is performed in the second display mode.

In the first display mode of the display unit of the Example 2, J first unit pixels configure a first sub-pixel, J second unit pixels configure a second sub-pixel, and J third unit pixels configure a third sub-pixel. In the second display mode thereof, j first unit pixels configure a first sub-pixel, j second unit pixels configure a second sub-pixel, and j third unit pixels configure a third sub-pixel.

Alternatively, in the first display mode, 3×q first unit pixels configure a first sub-pixel, 3×q second unit pixels configure a second sub-pixel, and 3×q third unit pixels configure a third sub-pixel. In the second display mode, q' first unit pixels configure a first sub-pixel, q' second unit pixels configure a second sub-pixel, and q' third unit pixels configure a third sub-pixel.

The first color emitted by the first unit pixel is red, the second color emitted by the second unit pixel is green, and the third color emitted by the third unit pixel is blue. The unit pixels are arranged in a delta or pseudo-delta arrangement.

Figure 6A:
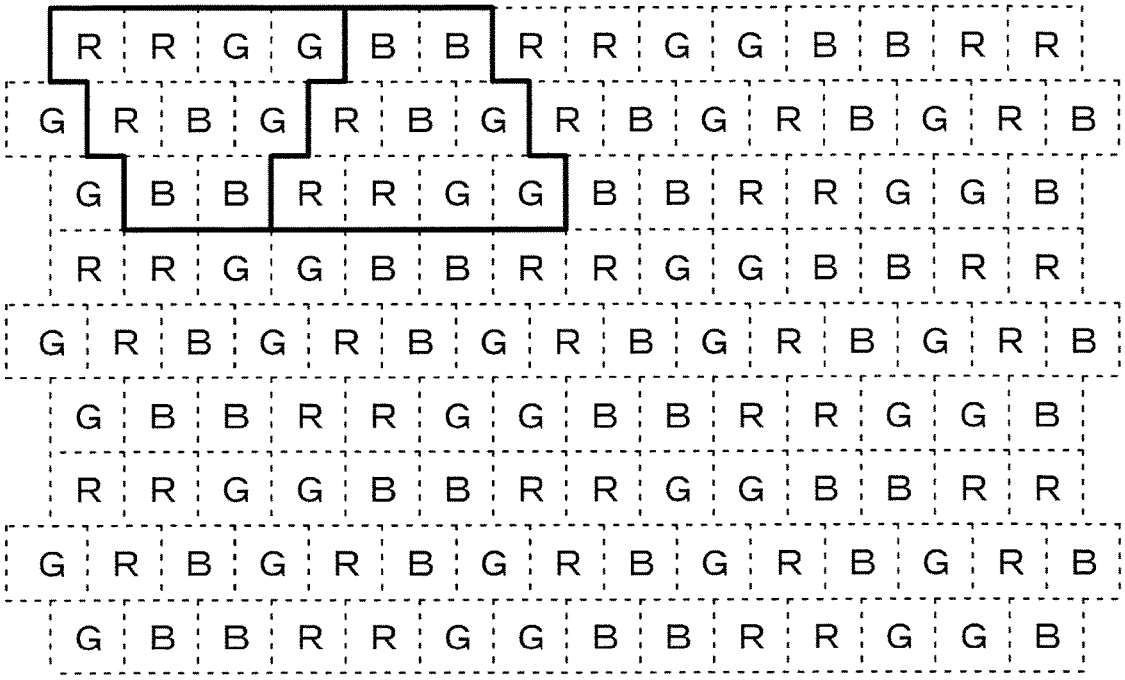
FIGS. 6A and 6B are schematic diagrams of an arrangement state of unit pixels showing one pixel in a first display mode and an arrangement state of unit pixels showing one pixel in a second display mode, respectively, in a display unit of Example 2.
Figure 6B:
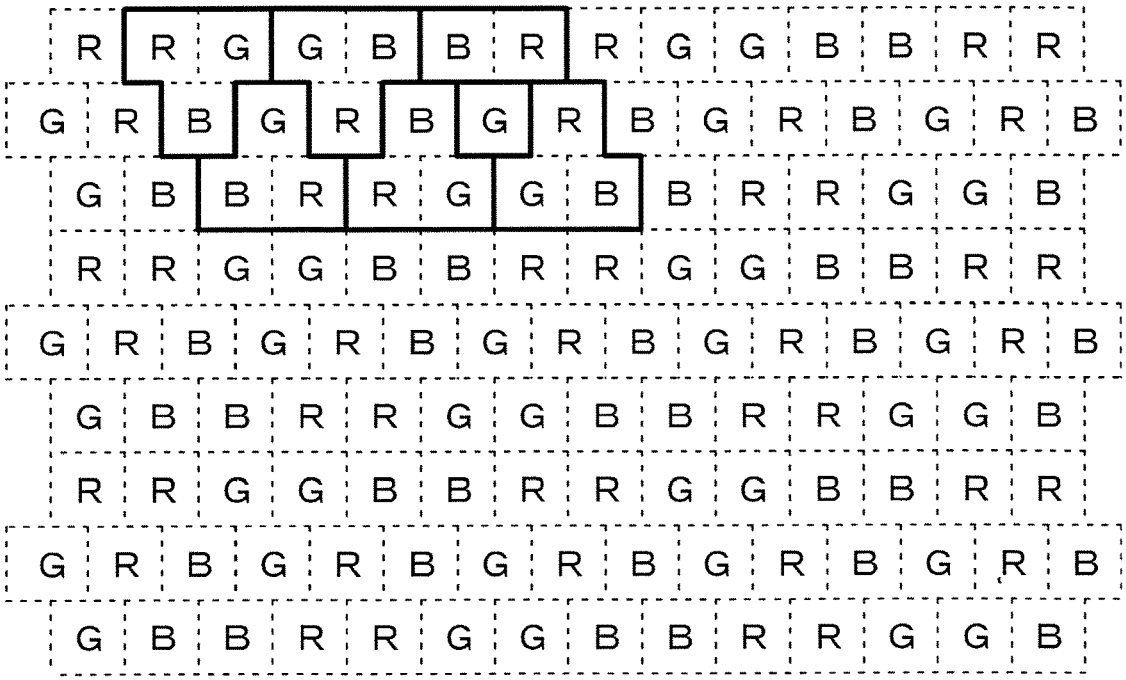
Figure 7A:
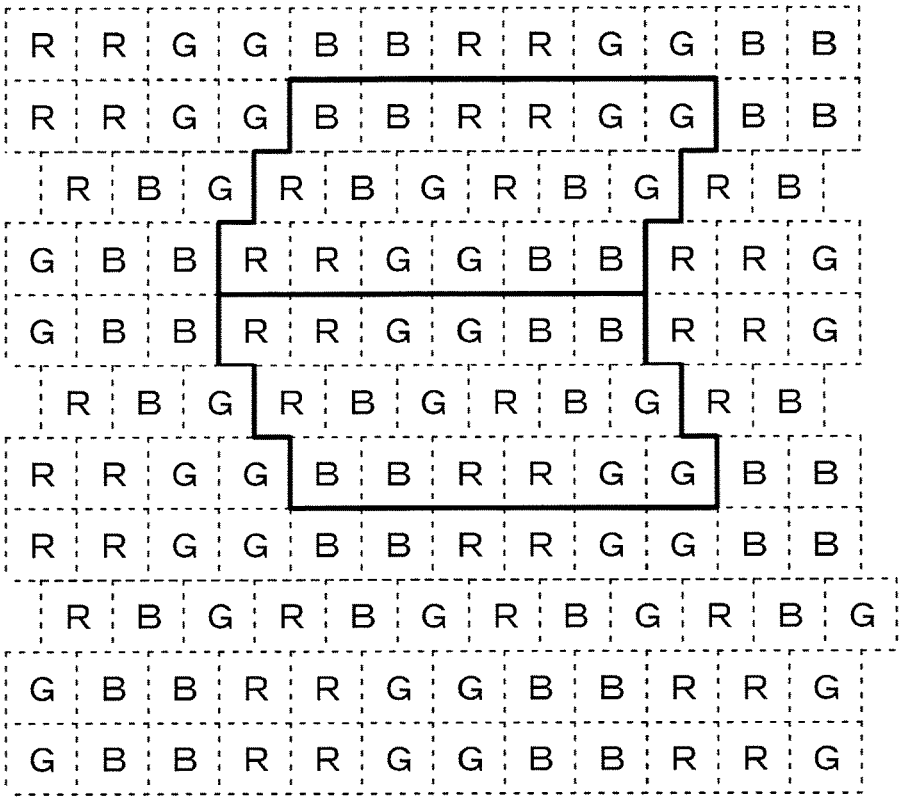
FIGS. 7A and 7B are schematic diagrams of an arrangement state of unit pixels showing one pixel in the first display mode and an arrangement state of unit pixels showing one pixel in the second display mode, respectively, in a Modification of the display unit of the Example 2.
Figure 7B:
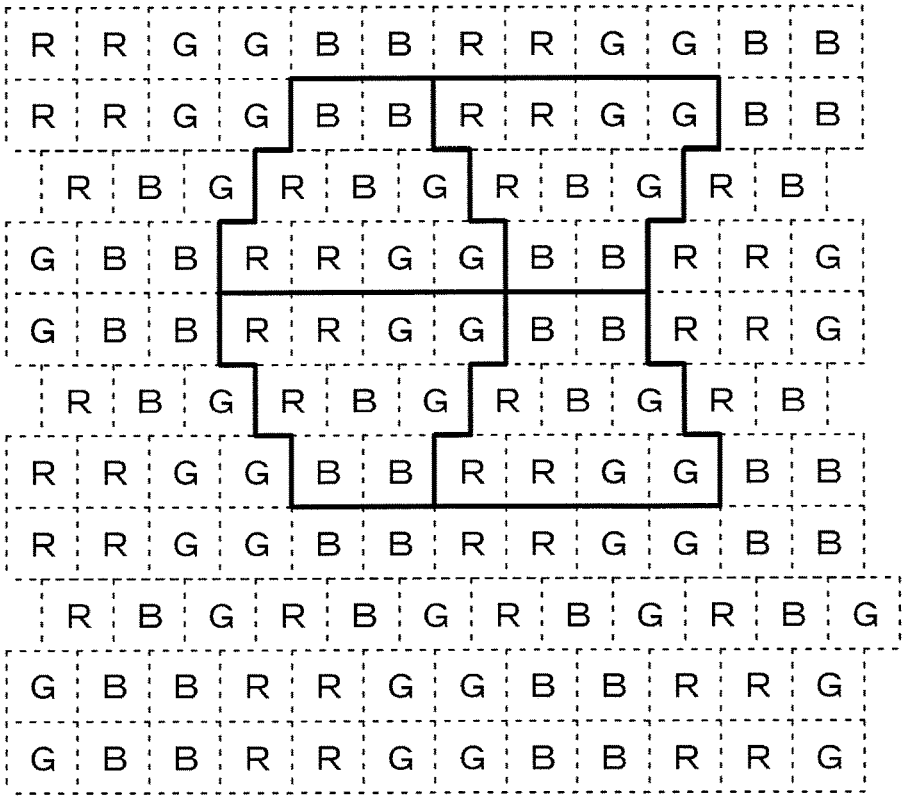
Figure 8A:
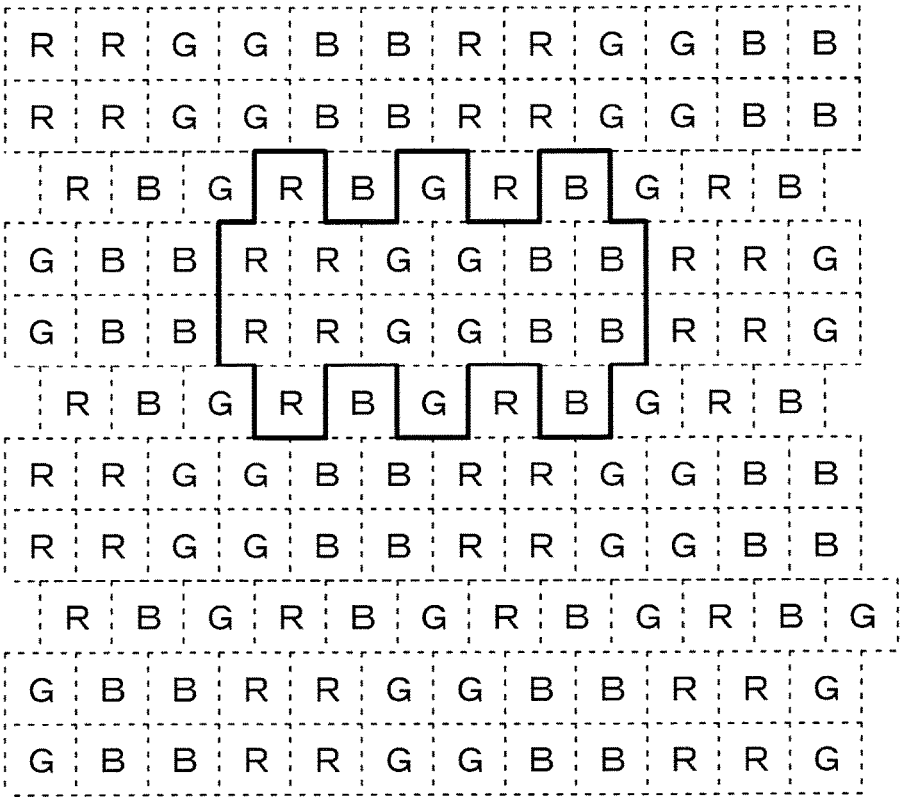
FIGS. 8A and 8B are schematic diagrams of an arrangement state of unit pixels showing one pixel in the first display mode and an arrangement state of unit pixels showing one pixel in the second display mode, respectively, in another Modification of the display unit of the Example 2
Figure 8B:
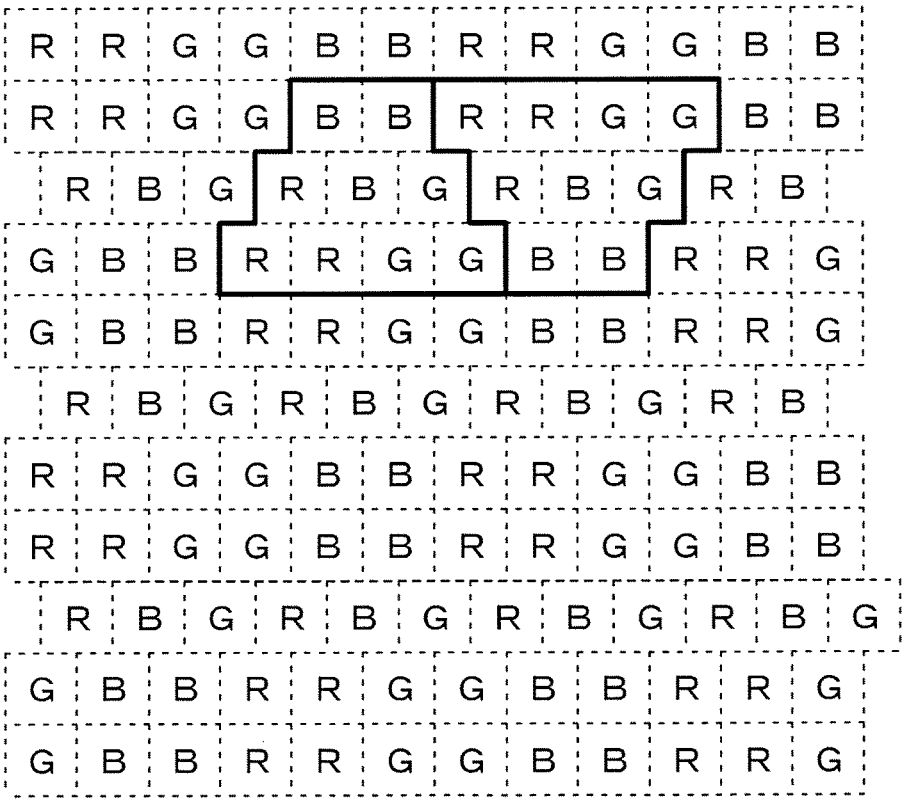
Figure 9A:
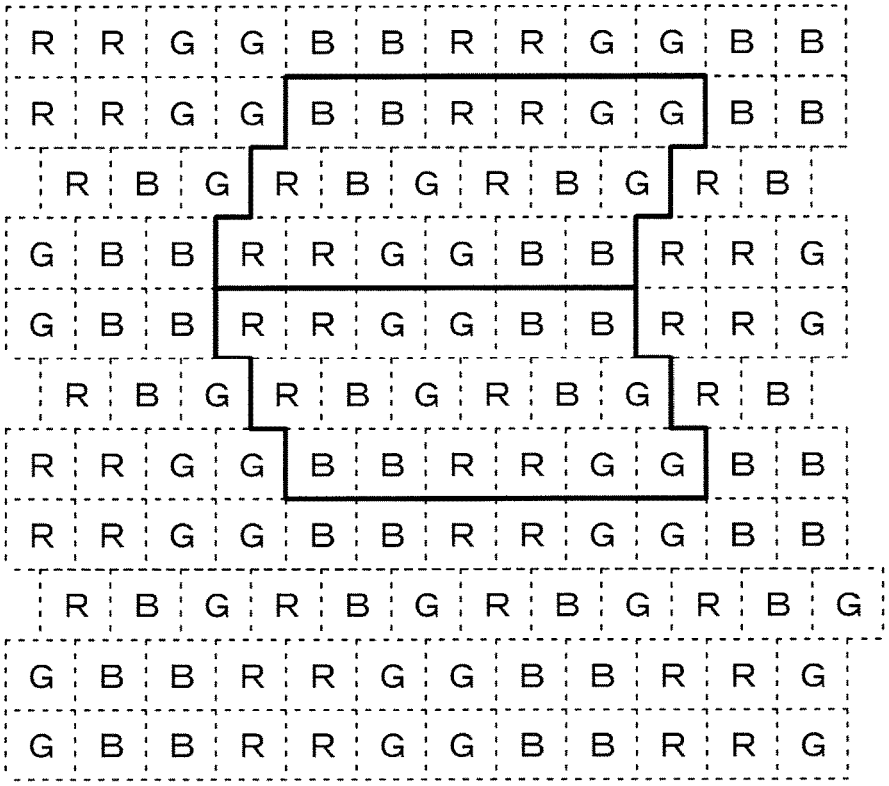
FIGS. 9A and 9B are schematic diagrams of an arrangement state of unit pixels showing one pixel in the first display mode and an arrangement state of unit pixels showing one pixel in the second display mode, respectively, in still another Modification of the display unit of the Example 2.
Figure 9B:
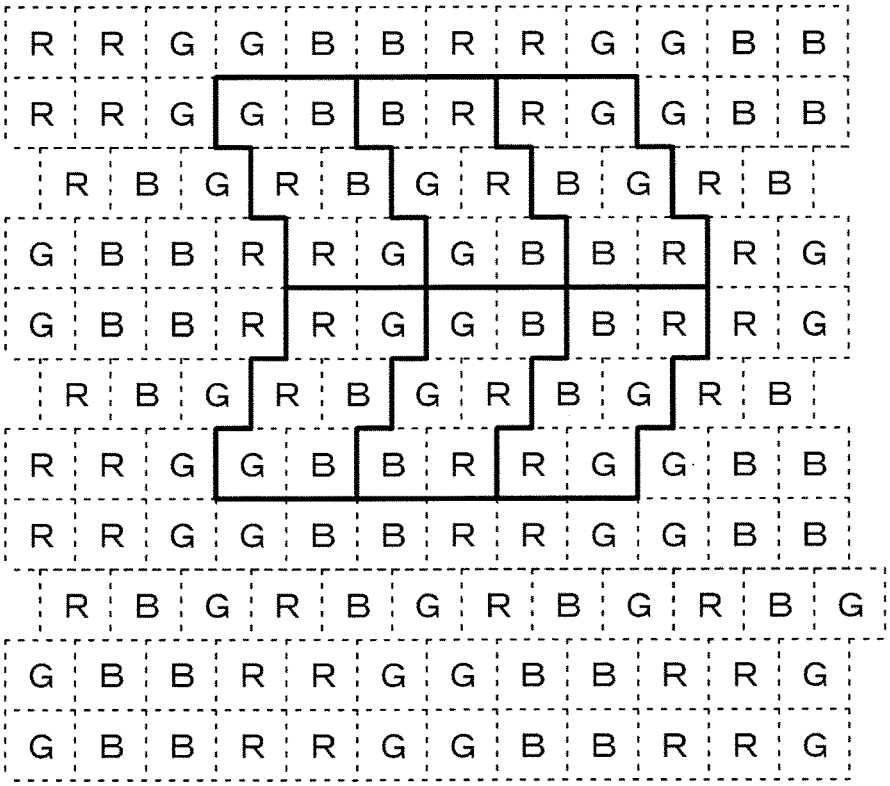
Figure 10A:
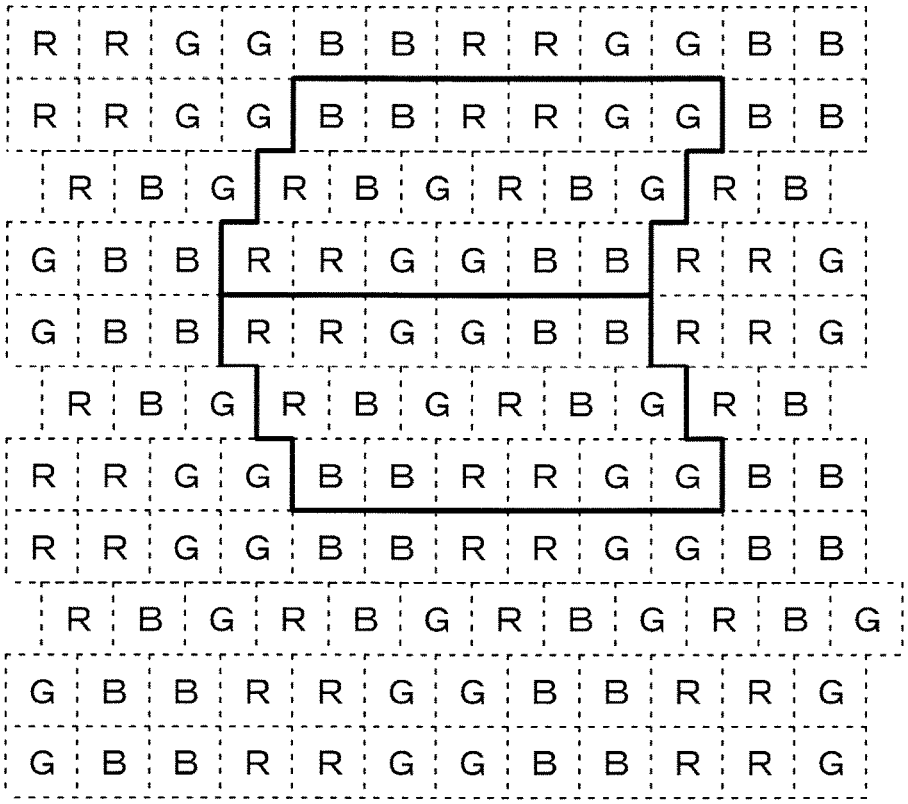
FIGS. 10A and 10B are schematic diagrams of an arrangement state of unit pixels showing one pixel in the first display mode and an arrangement state of unit pixels showing one pixel in the second display mode, respectively, in still another Modification of the display unit of the Example 2.
Figure 10B:
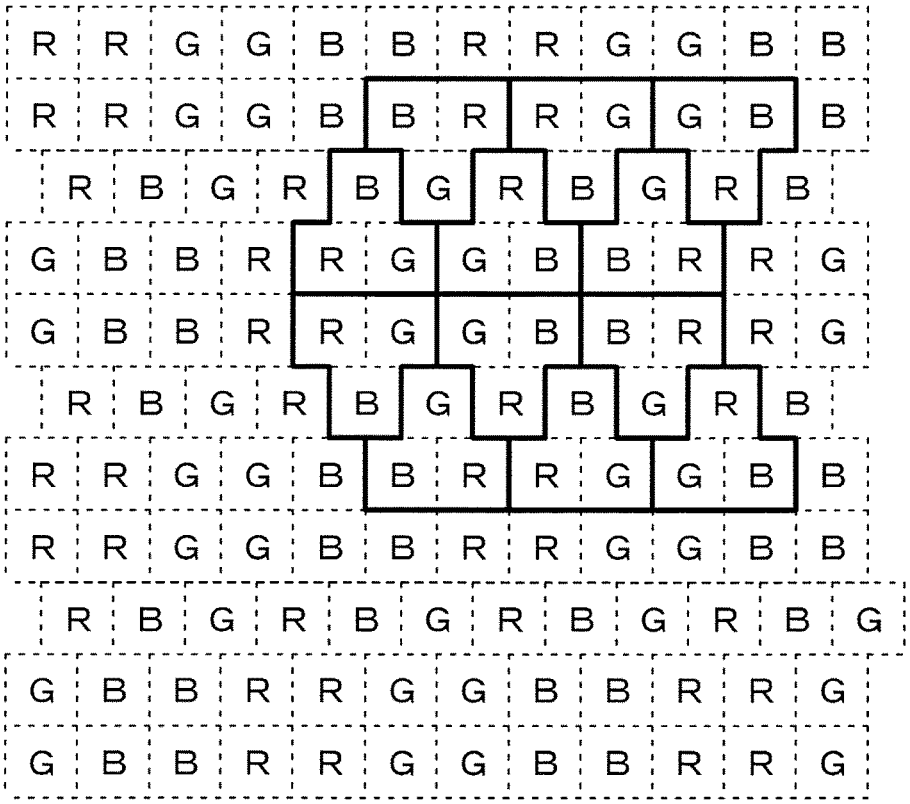
Figure 11:
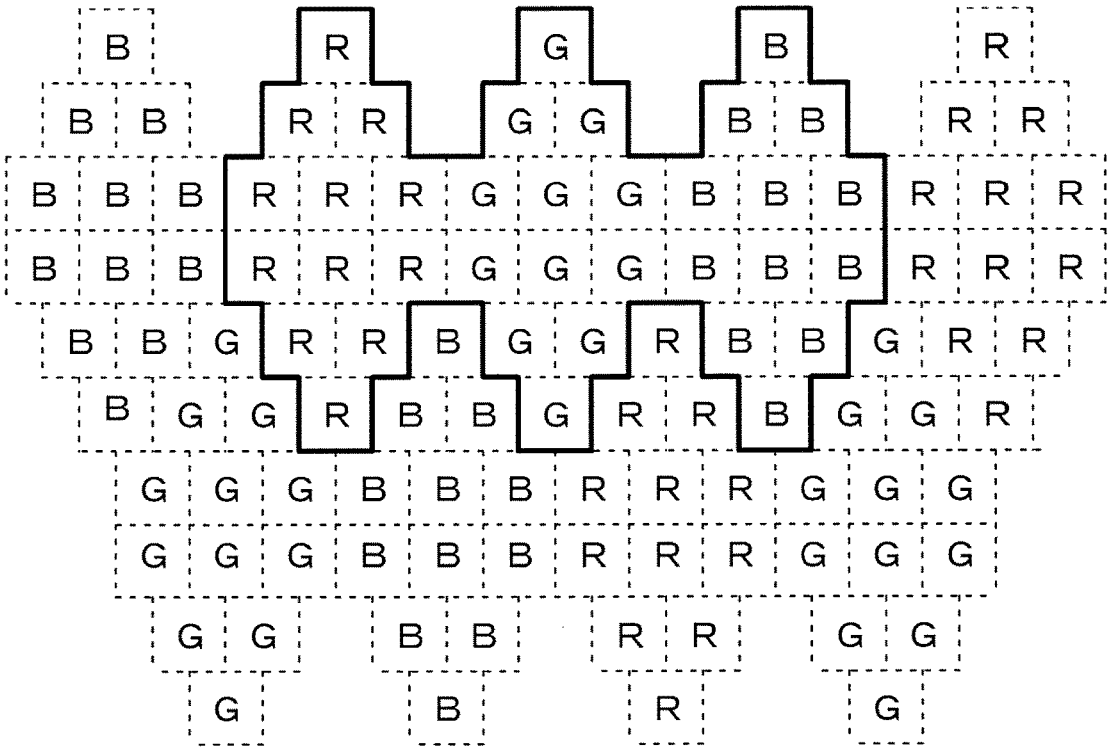
FIG. 11 is a schematic diagram of an arrangement state of unit pixels showing one pixel in the first display mode in still another Modification of the display unit of the Example 2.
Figure 12:
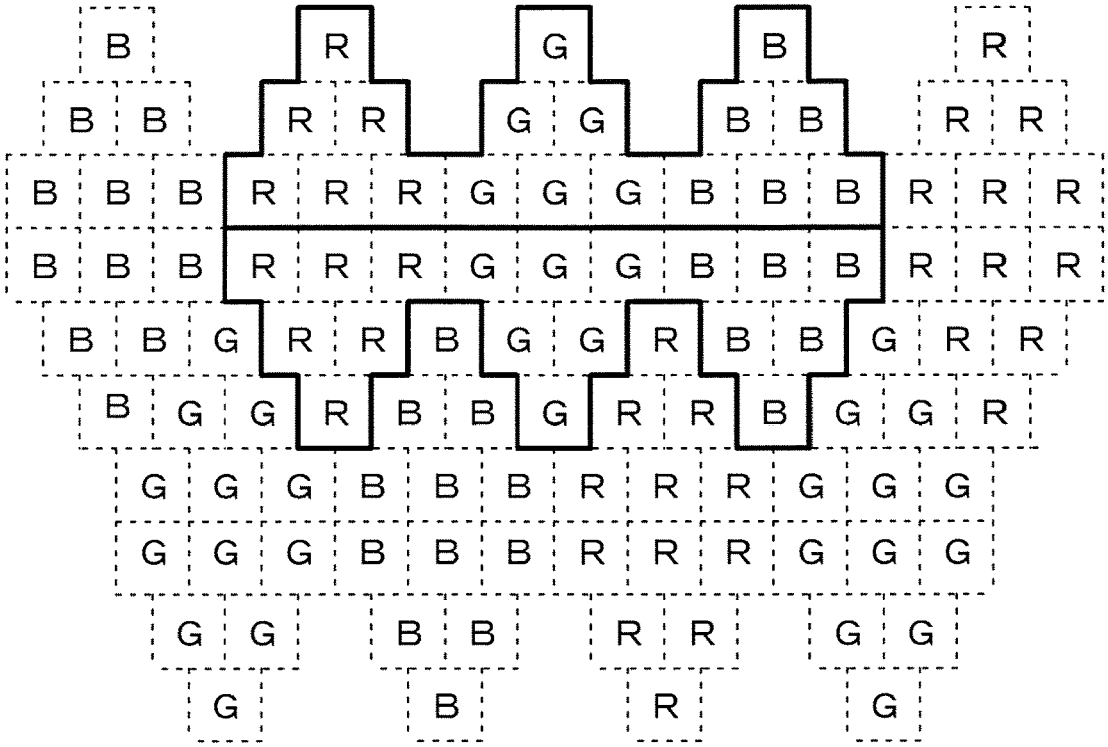
FIG. 12 is a schematic diagram of an arrangement state of unit pixels showing one pixel in the second display mode in the Modification illustrated in FIG. 11 of the display unit of the Example 2.

A combination (J, j) may include (3, 1) as illustrated in FIGS. 6A and 6B, (6, 3) as illustrated in FIGS. 7A and 7B or FIGS. 8A and 8B, (6, 2) as illustrated in FIGS. 9A and 9B, and (6, 1) as illustrated in FIGS. 10A and 10B. In addition, a combination (q, q') may include (1, 1) as illustrated in FIGS. 6A and 6B, (2, 3) as illustrated in FIGS. 7A and 7B or FIGS. 8A and 8B, (2, 2) as illustrated in FIGS. 9A and 9B, (2, 1) as illustrated in FIGS. 10A and 10B, (4, 6) as illustrated in FIGS. 11 and 12, and (6, 9) as illustrated in FIGS. 13A and 13B.

In the display unit of the Example 2, grayscale control is also performed through control of operation of each of the unit pixels in the first display mode. Furthermore, image display with a higher image resolution than that in the first display mode is performed in the second display mode.

In the exemplary case illustrated in FIGS. 6A and 6B, a combination (J, j) is (3, 1); hence, the following is established:

$$\text{pseudo-grayscale number} = J \times (N-1) + 1 = 10.$$

In the second display mode, the following is established:

$$\text{pseudo-grayscale number} = j \times (N-1) + 1 = 4.$$

When image resolution in the first display mode is "1", image resolution in the second display mode is "3".

Furthermore, in each of the exemplary cases illustrated in FIGS. 7A and 7B and FIGS. 8A and 8B, a combination (J, j) is (6, 3); hence, the following is established:

$$\text{pseudo-grayscale number} = J \times (N-1) + 1 = 19.$$

In the second display mode, the following is established:

$$\text{pseudo-grayscale number} = j \times (N-1) + 1 = 10.$$

When image resolution in the first display mode is "1", image resolution in the second display mode is "2".

Furthermore, in the exemplary case illustrated in FIGS. 9A and 9B, a combination (J, j) is (6, 2); hence, the following is established:

$$\text{pseudo-grayscale number} = J \times (N-1) + 1 = 19.$$

In the second display mode, the following is established:

$$\text{pseudo-grayscale number} = j \times (N-1) + 1 = 7.$$

When image resolution in the first display mode is "1", image resolution in the second display mode is "3".

Furthermore, in the exemplary case illustrated in FIGS. 10A and 10B, a combination (J, j) is (6, 1); hence, the following is established:

$$\text{pseudo-grayscale number} = J \times (N-1) + 1 = 19.$$

In the second display mode, the following is established:

$$\text{pseudo-grayscale number} = j \times (N-1) + 1 = 4.$$

When image resolution in the first display mode is "1", image resolution in the second display mode is "6". In each of the exemplary cases illustrated in FIGS. 11 and 12 and FIGS. 13A and 13B, when image resolution in the first display mode is "1", image resolution in the second display mode is "2".

An electronic apparatus of the Example 2 includes the above-described display unit of the Example 2.

In the Example 2, image display corresponding to image signals may also be prevented at an edge portion of the image display region of the display unit depending on a configuration of one pixel. In such a case, non-display processing (for example, processing of inputting a luminance signal "0" to a unit pixel) is appropriately performed to such a unit pixel that is prevented from performing image display corresponding to image signals, i.e., does not belong to any one pixel.

Although the present disclosure has been described based on the preferable Examples, the disclosure is not limited thereto. The configurations and/or structures of the display units, the electronic apparatuses, and the methods of driving the display unit described in the Examples are merely shown as examples, and may be appropriately modified or altered.

It is to be noted that the present disclosure may be configured as follows.

(1) (Display Unit: First Embodiment)

A display unit, including a plurality of pixels arranged in a two-dimensional matrix, wherein an image is displayed in a first display mode and a second display mode, in the first display mode, one pixel is configured of a set including J (where J is an integer of 2 or more) first unit pixels emitting a first color, J second unit pixels emitting a second color, and J third unit pixels emitting a third color, and image display is performed through control of operation of each of the unit pixels, and in the second display mode, one pixel is configured of a set including j (where j is an integer of 1 or more and less than J) first unit pixels, j second unit pixels, and j third unit pixels, and image display is performed through control of operation of each of the unit pixels.

(2) The display unit according to (1), wherein in the first display mode, one pixel is configured of a set of J first unit pixels, J second unit pixels, J third unit pixels, and J fourth unit pixels emitting a fourth color, and image display is performed through control of operation of each of the unit pixels, and in a second display mode, one pixel is configured of a set of j first unit pixels, j second unit pixels, j third unit pixels, and j fourth unit pixels, and image display is performed through control of operation of each of the unit pixels.

(3) The display unit according to (2), wherein a combination (J, j) is one of (4, 1), (16, 1), and (16, 4).

(4) The display unit according to (1), wherein in the first display mode, one pixel is configured of a set of J first unit pixels, J second unit pixels, and J third unit pixels, and image display is performed through control of operation of each of the unit pixels, and in the second display mode, one pixel is configured of a set of j first unit pixels, j second unit pixels, and j third unit pixels, and image display is performed through control of operation of each of the unit pixels.

(5) The display unit according to (4), wherein a combination (J, j) is one of (3, 1), (6, 1), (6, 2) and (6, 3).

(6) The display unit according to any one of (1) to (5), wherein grayscale control is performed through control of operation of each of the unit pixels in the first display mode.

(7) The display unit according to any one of (1) to (6), wherein image display with a higher image resolution than an image resolution of image display in the first display mode is performed in the second display mode.

(8) The display unit according to any one of (1) to (7), wherein an image is relatively reduced in the first display mode, and an image is relatively expanded in the second display mode.

(9) The display unit according to any one of (1) to (8), further including a mode switcher configured to switch the first display mode and the second display mode from each other.

(10) The display unit according to any one of (1) to (8), wherein the first display mode and the second display mode are switched from each other based on an external mode switching signal allowing the first display mode and the second display mode to be switched from each other.

(11) The display unit according to any one of (1) to (8), wherein the image display in the first display mode or the image display in the second display mode is selected based on an image to be displayed.

(12) The display unit according to any one of (1) to (11), wherein a luminance signal "0" is input to a unit pixel that does not belong to any one pixel and is located at an edge portion of an image display region having the plurality of pixels arranged in a two-dimensional matrix.

(13) The display unit according to any one of (1) to (12), wherein the display unit is an electrophoretic display unit.

(14) (Display Unit: Second Embodiment)

A display unit, including a plurality of pixels arranged in a two-dimensional matrix, wherein an image is displayed in a first display mode and a second display mode, in the first display mode, one pixel is configured of a set of $4^p$ (where p is an integer of 1 or more) first unit pixels emitting a first color, $4^p$ second unit pixels emitting a second color, $4^p$ third unit pixels emitting a third color, and $4^p$ fourth unit pixels emitting a fourth color, and image display is performed through control of operation of each of the unit pixels, and in the second display mode, one pixel is configured of a set of $4^{p'}$ (where p' is an integer of (p−1) or less) first unit pixels, $4^{p'}$ second unit pixels, $4^{p'}$ third unit pixels, and $4^{p'}$ fourth unit pixels, and image display is performed through control of operation of each of the unit pixels.

(15) The display unit according to (14), wherein grayscale control is performed through control of operation of each of the unit pixels in the first display mode.

(16) The display unit according to (14) or (15), wherein image display with an image resolution $4^{p-p'}$ times as high as an image resolution of image display in the first display mode is performed in the second display mode.

(17) The display unit according to any one of (14) to (16), wherein the $4^p$ first unit pixels in the first display mode occupy a first quadrant of one pixel in the first display mode while being arranged in $2^p \times 2^p$, the $4^p$ second unit pixels in the first display mode occupy a second quadrant of one pixel in the first display mode while being arranged in $2^p \times 2^p$, the $4^p$ third unit pixels in the first display mode occupy a third quadrant of one pixel in the first display mode while being arranged in $2^p \times 2^p$, the $4^p$ fourth unit pixels in the first display mode occupy a fourth quadrant of one pixel in the first display mode while being arranged in $2^p \times 2^p$, and p'=(p−1) is satisfied.

(18) The display unit according to any one of (14) to (17), wherein an image is relatively reduced in the first display mode, and an image is relatively expanded in the second display mode.

(19) The display unit according to any one of (14) to (18), further including a mode switcher configured to switch the first display mode and the second display mode from each other.

(20) The display unit according to any one of (14) to (18), wherein the first display mode and the second display mode are switched from each other based on an external mode switching signal allowing the first display mode and the second display mode to be switched from each other.

(21) The display unit according to any one of (14) to (18), wherein the image display in the first display mode or the image display in the second display mode is selected based on an image to be displayed.

(22) The display unit according to any one of (14) to (21), wherein a luminance signal "0" is input to a unit pixel that does not belong to any one pixel and is located at an edge portion of an image display region having the plurality of pixels arranged in a two-dimensional matrix.

(23) The display unit according to any one of (14) to (22), wherein the display unit is an electrophoretic display unit.

(24) (Display Unit: Third Embodiment)

A display unit, including a plurality of pixels arranged in a two-dimensional matrix, wherein an image is displayed in a first display mode and a second display mode, in the first display mode, one pixel is configured of a set of 3×q (where q is 1 or an even number) first unit pixels emitting a first color, 3×q second unit pixels emitting a second color, and 3×q third unit pixels emitting a third color, and image display is performed through control of operation of each of the unit pixels, and in the second display mode, q'=1 is given in the case of q=1, q'=1, 2, or 3 is given in the case of q=2, and q'=(3×q)/2 is given in the case of q being an even number of more than 2, and one pixel is configured of a set of q' first unit pixels, q' second unit pixels, and q' third unit pixels, and image display is performed through control of operation of each of the unit pixels.

(25) The display unit according to (24), wherein grayscale control is performed through control of operation of each of the unit pixels in the first display mode.

(26) The display unit according to (24) or (25), wherein image display with a higher image resolution than an image resolution of image display in the first display mode is performed in the second display mode.

(27) The display unit according to any one of (24) to (26), wherein an image is relatively reduced in the first display mode, and an image is relatively expanded in the second display mode.

(28) The display unit according to any one of (24) to (27), further including a mode switcher configured to switch the first display mode and the second display mode from each other.

(29) The display unit according to any one of (24) to (27), wherein the first display mode and the second display mode are switched from each other based on an external mode switching signal allowing the first display mode and the second display mode to be switched from each other.

(30) The display unit according to any one of (24) to (27), wherein the image display in the first display mode or the image display in the second display mode is selected based on an image to be displayed.

(31) The display unit according to any one of (24) to (30), wherein a luminance signal "0" is input to a unit pixel that does not belong to any one pixel and is located at an edge portion of an image display region having the plurality of pixels arranged in a two-dimensional matrix.

(32) The display unit according to any one of (24) to (31), wherein the display unit is an electrophoretic display unit.

(33) (Electronic Apparatus)

An electronic apparatus, including the display unit according to any one of (1) to (32).

(34) (Method of Driving Display Unit)

A method of driving a display unit, the display unit including a plurality of pixels arranged in a two-dimensional matrix, the method including:

allowing the display unit to display an image in a first display mode and a second display mode;

in the first display mode, allowing the display unit to perform image display by configuring one pixel by a set including J (where J is an integer of 2 or more) first unit pixels emitting a first color, J second unit pixels emitting a second color, and J third unit pixels emitting a third color, and controlling operation of each of the unit pixels;

in the second display mode, allowing the display unit to perform image display by configuring one pixel by a set including j (where j is an integer of 1 or more and less than J) first unit pixels, j second unit pixels, and j third unit pixels, and controlling operation of each of the unit pixels; and switching a display mode between the first display mode and the second display mode based on a mode switching signal, the mode switching signal allowing the first display mode and the second display mode to be switched from each other.

It should be understood by those skilled in the art that various modifications, combinations, sub-combinations and alterations may occur depending on design requirements and other factors insofar as they are within the scope of the appended claims or the equivalents thereof.

What is claimed is:

1. A display unit, comprising:

a plurality of pixels arranged in a two-dimensional matrix, wherein an image is displayed in a first display mode or a second display mode based on a selection of a display mode, wherein the first display mode is different from the second display mode, wherein in the first display mode, one pixel of the plurality of pixels is configured of a first set that includes J first unit pixels that emits a first color, J second unit pixels that emits a second color, J third unit pixels that emits a third color, and J fourth unit pixels that emit a fourth color, and the image is displayed through control of operation of each of the J first unit pixels to the J fourth unit pixels, wherein J is an integer, wherein in the second display mode, the one pixel of the plurality of pixels is configured of a second set that includes j first unit pixels, j second unit pixels, j third unit pixels, and j fourth unit pixels, and the image is displayed through the control of operation of each of the j first unit pixels to the j fourth unit pixels, wherein j is an integer with a value less than J, and wherein a combination (J, j) is one of (6, 1), (6, 2) or (6, 3).

2. The display unit according to claim 1, wherein a combination (J, j) is one of (4, 1), (16, 1), and (16, 4).

3. The display unit according to claim 1, wherein the display unit is configured to control grayscale through the control of the operation of each of the J first unit pixels to the J fourth unit pixels in the first display mode.

4. The display unit according to claim 1, wherein, in the second display mode, the display unit is configured to display the image with a higher image resolution than an image resolution of the image displayed in the first display mode.

5. The display unit according to claim 1, wherein the image displayed in the first display mode is relatively reduced as compared to the image displayed in the second display mode.

6. The display unit according to claim 1, further comprising a mode switcher configured to switch the display mode of the display unit between the first display mode and the second display mode.

7. The display unit according to claim 1, wherein the display mode is switched between the first display mode and the second display mode based on an external mode switching signal that allows the first display mode and the second display mode to be switched.

8. The display unit according to claim 1, wherein the display unit is an electrophoretic display unit.

9. The display unit according to claim 1, wherein the display mode of the display unit is selected based on the image to be displayed.

10. A display unit, comprising:

a plurality of pixels arranged in a two-dimensional matrix, wherein an image is displayed in a first display mode or a second display mode based on a selection of a display mode, wherein the first display mode is different from the second display mode, wherein in the first display mode, one pixel of the plurality of pixels is configured of a first set of $4^P$ first unit pixels that emits a first color, $4^P$ second unit pixels that emits a second color, $4^P$ third unit pixels that emits a third color, and $4^P$ fourth unit pixels that emits a fourth color, and the image is displayed through control of operation of each of the $4^P$ first unit pixels to the $4^P$ fourth unit pixels, wherein p is an integer with a first value of 1 or more, wherein in the second display mode, the one pixel of the plurality of pixels is configured of a second set of $4^{P'}$ first unit pixels, $4^{P'}$ second unit pixels, $4^{P'}$ third unit pixels, and $4^{P'}$ fourth unit pixels, and the image is displayed through the control of operation of each of the $4^{P'}$ first unit pixels to the $4^{P'}$ fourth unit pixels, wherein p' is an integer with a second value of (p−1) or less, and wherein the display unit is configured to display the image in the second display mode with an image resolution $4^{P-P'}$ times higher than the image resolution of the image displayed in the first display mode.

11. The display unit according to claim 9, wherein the display unit is further configured to control grayscale through the control of the operation of each of the $4^P$ first unit pixels to the $4^P$ fourth unit pixels in the first display mode.

12. The display unit according to claim 10, wherein the $4^P$ first unit pixels in the first display mode occupy a first quadrant of the one pixel in the first display mode while arranged in a $2^P \times 2^P$ arrangement, the $4^P$ second unit pixels in the first display mode occupy a second quadrant of the one pixel in the first display mode while arranged in the $2^P \times 2^P$ arrangement, the $4^P$ third unit pixels in the first display mode occupy a third quadrant of the one pixel in the first display mode while arranged in the $2^P \times 2^P$ arrangement, the $4^P$ fourth unit pixels in the first display mode occupy a fourth quadrant of the one pixel in the first display mode while arranged in the $2^P \times 2^P$ arrangement, and p'=(p−1) is satisfied.

13. A display unit, comprising:

a plurality of pixels arranged in a two-dimensional matrix, wherein an image is displayed in a first display mode or a second display mode based on a display mode selected, wherein the first display mode is different from the second display mode, wherein in the first display mode, one pixel of the plurality of pixels is configured of a first set of 3×q first unit pixels that emits a first color, 3×q second unit pixels that emits a second color, and 3×q third unit pixels that emits a third color, and the image is displayed through control of operation of each of the 3×q first unit pixels to the 3×q third unit pixels, wherein q is an integer with a value of 1 or an even number, and wherein in the second display mode, q'=1 is given where q=1, q'=1, 2, or 3 is given where q=2, and q'=(3×q)/2 is given where q is an even number with a value of more than 2, and the one pixel is configured of a second set of q' first unit pixels, q' second unit pixels, and q' third unit pixels, and the image is displayed through the control of operation of each of the q' first unit pixels to the q' third unit pixels.

14. The display unit according to claim 13, wherein the display unit is configured to control grayscale through the control of operation of each of the 3×q first unit pixels to the 3×q third unit pixels in the first display mode.

15. The display unit according to claim 13, wherein the display unit is configured to display the image with a higher image resolution in the second display mode than an image resolution of the image displayed in the first display mode.

16. An electronic apparatus, comprising:

a display unit comprising:

a plurality of pixels arranged in a two-dimensional matrix, wherein an image is displayed in a first display mode or a second display mode based on a display mode selected, wherein the first display mode is different from the second display mode, wherein in the first display mode, one pixel of the plurality of pixels is configured of a first set which includes J first unit pixels that emits a first color, J second unit pixels that emits a second color, J third unit pixels that emits a third color, and J fourth unit pixels that emit a fourth color, and the image is displayed through control of operation of each of the J first unit pixels to the J fourth unit pixels, wherein J is an integer, wherein in the second display mode, the one pixel of the plurality of pixels is configured of a second set that includes j first unit pixels, j second unit pixels, j third unit pixels, and j fourth unit pixels, and the image is displayed through the control of operation of each of the j first unit pixels to the j fourth unit pixels, wherein j is an integer with a value less than J, and wherein a combination (J, j) is one of (6, 1), (6, 2) or (6, 3).

17. A method of driving a display unit, the method comprising:

in the display unit including a plurality of pixels arranged in a two-dimensional matrix:

allowing the display unit to display an image in a first display mode or a second display mode based on a display mode selected, wherein the first display mode is different from the second display mode, wherein in the first display mode, allowing the display unit to display the image by configuring one pixel of the plurality of pixels by a first set including J first unit pixels emitting a first color, J second unit pixels emitting a second color, J third unit pixels emitting a third color, and J fourth unit pixels emitting a fourth color, and controlling operation of each of the J first unit pixels to the J fourth unit pixels, wherein J is an integer, wherein in the second display mode, allowing the display unit to display the image by configuring the one pixel of the plurality of pixels by a second set including j first unit pixels, j second unit pixels, j third unit pixels, and j fourth unit pixels, and controlling operation of each of the j first unit pixels to the j fourth unit pixels, wherein j is an integer with a value less than J, and wherein a combination (J, j) is one of (6, 1), (6, 2) or (6, 3); and switching the display mode between the first display mode and the second display mode based on a mode switching signal, the mode switching signal allowing the display mode to be switched between the first display mode and the second display mode.

* * * * *